US008350139B2

(12) United States Patent
Lutz et al.

(10) Patent No.: US 8,350,139 B2
(45) Date of Patent: Jan. 8, 2013

(54) DEVICE FOR ADJUSTING AND BLOCKING A SNARE BAND

(76) Inventors: Bernard Martin Lutz, Schleedorf (AT); Josef Rettenbacher, Schleedorf (AT)

( * ) Notice: Subject to any disclaimer, the term of this patent is extended or adjusted under 35 U.S.C. 154(b) by 267 days.

(21) Appl. No.: 12/523,103

(22) PCT Filed: Jan. 9, 2008

(86) PCT No.: PCT/EP2008/000117

§ 371 (c)(1),
(2), (4) Date: Mar. 25, 2010

(87) PCT Pub. No.: WO2008/083960

PCT Pub. Date: Jul. 17, 2008

(65) Prior Publication Data

US 2010/0206155 A1 Aug. 19, 2010

(30) Foreign Application Priority Data

Jan. 14, 2007 (DE) ..... 20 2007 000 375 U

(51) Int. Cl.
*G10D 13/02* (2006.01)

(52) U.S. Cl. ..... 84/415

(58) Field of Classification Search ..... 84/415
See application file for complete search history.

(56) References Cited

U.S. PATENT DOCUMENTS

| | | | | |
|---|---|---|---|---|
| 1,722,032 | A * | 7/1929 | Bower | 84/415 |
| 2,198,406 | A * | 4/1940 | Deans et al. | 84/415 |
| 4,203,343 | A | 5/1980 | Bargeman | |
| 4,383,467 | A * | 5/1983 | Glassford, Jr. | 84/415 |
| 6,043,420 | A * | 3/2000 | Arnold | 84/411 M |
| 6,700,046 | B2 | 3/2004 | Cherbettchian | |
| 2002/0083817 | A1 | 7/2002 | Hoshno | |
| 2002/0178895 | A1 * | 12/2002 | Cherbettchian | 84/415 |
| 2005/0188818 | A1 | 9/2005 | Okamoto | |
| 2005/0204895 | A1 | 9/2005 | Yu-Hwa | |
| 2006/0213354 | A1 * | 9/2006 | Takegawa | 84/415 |
| 2006/0219084 | A1 * | 10/2006 | Dunnett | 84/415 |
| 2006/0266198 | A1 | 11/2006 | Jeffries | |

FOREIGN PATENT DOCUMENTS

| | | | |
|---|---|---|---|
| DE | 8403080 | U1 | 5/1984 |
| DE | 10209486 | C1 | 8/2003 |
| DE | 102005001004 | A1 | 8/2005 |
| DE | 10126914 | B4 | 2/2006 |
| GB | 490988 | A | 8/1938 |
| GB | 2192086 | A | 12/1987 |

* cited by examiner

*Primary Examiner* — Jianchun Qin
(74) *Attorney, Agent, or Firm* — Pai Patent & Trademark Law Firm; Chao-Chang David Pai

(57) ABSTRACT

A snare band adjustment and locking device of a snare drum includes a mechanism for adjusting first, second and third settings, a first setting wherein the snare band is removed from the snare head, a second setting wherein the snare band has a maximum, predetermined contact pressure with the snare head, and a third setting wherein the contact pressure of the snare band with the snare head can be continuously varied between the contact pressure in the first and second settings. The adjustment mechanism is operated in the third setting via a foot pedal and a cable running through a control member which determines by its tension the spacing between the control member and a control lever pretensioned by a compression spring.

21 Claims, 21 Drawing Sheets

15°
5
3d,4d
3,4
3c,4c
R 7
29
View A
3,4
30°
3b,4b
R 20
3a,4a
3
42,5
A
39,5
3,4
18,5
9
Ø 25
3
2
10
3
R 8
3
28
3d,4d
17
108

Sectional View A-A

Sectional View A-A

DEVICE FOR ADJUSTING AND BLOCKING A SNARE BAND

OBJECT OF THE INVENTION

The invention relates to a snare band adjustment and locking device of a snare drum, comprising a positioning mechanism for varying the contact pressure of the snare band with the snare head, the positioning mechanism being configured so that in a first setting of the positioning mechanism the snare band is lifted off from the snare head whereas in a second setting the snare band has a predetermined maximum contact pressure with the snare head.

PRIOR ART

Drums featuring a snare band/carpet, for instance brush, marching or snare drums are drumheaded on both sides with snare cords on the snare head. The snare carpet may comprise, for example, several wire coils located side-by-side which may, however, be made of other materials.

Drum batter causes the snare carpet contacting the snare head to vibrate in sympathy, producing the snare sound by the snare head communicating the vibrations of the batter head, resulting in the typical snare sound of the drum. A mechanism is provided to lift the carpet from the snare head to change the sound of the drum.

On the basis of prior art the object of the invention is to expand the musical possibilities of a known snare drum.

TECHNICAL ACHIEVEMENT

This object is achieved by a snare band adjustment and locking device of a snare drum as it reads from claim 1. Preferred embodiments read from the dependent claims.

The snare band adjustment and locking device of a snare drum comprises an adjustment mechanism for setting a first setting in which the snare band is lifted off from the snare head and for setting a second setting in which the snare band is in contact with the snare head with a defined maximum contact pressure. The adjustment mechanism comprises furthermore a positioning mechanism providing a third setting of the adjustment mechanism in which the contact pressure of the snare band with the snare head can be continuously varied between the contact pressure in the first setting and the contact pressure in the second setting.

The system in accordance with the invention now provides a three-stage automatic system for lifting off a snare carpet in three stages, in the one, or mode, of which (third setting) the wanted carpet tension can be continuously varied. The contact pressure is determined by the tension of the snare head band or snare carpet.

In a first setting the carpet is lifted off totally from the snare head by turning a first lever. Pressing a button switches the system in accordance with the invention to a setting or an intermediate stage. In this setting a fine adjustment mechanism is activated or released permitting continuously variable fine adjustment of the carpet between full OFF and full ON. Pressing a second button causes the carpet, by means of a controllable spring force, to assume a further setting in which it is automatically fully tensioned. Between the first, second and third setting a change can be made in any sequence by actuating the corresponding actuator elements.

In particular, the adjustment mechanism comprises at least one first and/or second actuating element which can be actuated to make the change from the first and/or second setting into the third setting. With the aid of an actuating element, for example a lever or button, the snare band can be lifted off from the snare head, the carpet being totally lifted off from the head in this stage. By unlocking the actuating lever (lock) the contact pressure of the snare band can be continuously varied. In this condition all stages are disabled and the snare band is automatically tensioned.

The adjustment mechanism comprises preferably at least one actuator, by means of which the positioning mechanism for continuously varying the contact pressure of the snare band on the snare head can be actuated between the first and the second setting.

The actuator comprises in particular a foot pedal by means of which the positioning mechanism can be actuated to continuously vary the contact pressure of the snare band on the snare head.

The device comprises preferably at least one controller operated by means of the actuator.

The controller can be operated particularly by means of an elastic element. For continuously variable control a control head is mounted which can be operated for example by a foot pedal connected by a sheathed cable or wire (e.g. Bowden cable), thus enabling the tension on the snare band to be continuously varied, without manual operation, from fully off to maximum tension. On release of the foot pedal the snare band is automatically tensioned, on actuation the snare band is automatically released. It is, however, also possible to configure the device so that on release of the foot pedal the snare band is automatically released and on actuation it is tensioned, thus making it possible to tension and release the carpet practically noiselessly when the drum is not being played.

The device may comprise at least one pretensioned roll.

The device comprises in particular at least two lift-off mechanisms for lifting off the snare band from the snare head.

One end of the snare band can be fixed, for example to the hoop of the drum whilst the other end is movable in relation to the hoop. The lift-off mechanism (adjustment mechanism) achieves setting lift-off and/or contact pressure of the snare band on the snare head.

In the preferred embodiment, however, the snare band is provided at both ends with an adjustment or lift-off mechanism in accordance with the invention, i.e. enabling it to be moved and lifted off at both ends in relation to the snare head. Making use of two, left and right, lift-off mechanisms permits the use of a dual-cable foot pedal to guarantee lift-off of the carpet absolutely parallel, eliminating any shear effect between the edge of the drum and the snare band.

The device may comprise at least one compression screw which can be preset to automatically obtain the wanted maximum contact pressure of the snare band on the drum.

The device may comprise at least one control member mounted continuously variable on a base member for optimizing the spacing between the controller and the compression screw.

Described in addition, is a clip-on snare band replacement system enabling the carpet tensioning head together with the snare band to be removed by pressing a three-stage automatic button. The snare band can be clipped on a kind of rule, one side of which is adjustable, enabling the band to be tensioned and the adjustable side of the rule fixed. The length of the snare band can be read off from a rule. Since the actual length of the band is known, the new snare band can be fitted exactly to the same length. The snare band to be fitted is then unclipped from the rule and clipped onto the three-stage automatic system, it also being possible to use snare bands already prepared for fitting to the three-stage automatic system when needed.

New to the system is designing it with a steel cable guide with a moving steel cable without an elongation rod, now making it possible to position drum and control pedal just as the drummer desires with no detriment to the function and quality of his performance. The length between lift-off and control pedal always remains the same, making for precise control of performance.

In conventional systems lift-off is lever-actuated, i.e. involving a radial circular motion. Since a travel of 10 mm is need at the most to fully lift-off the snare band from being tensioned, a very long travel materializes which is controlled by means of a linkage. Once the drum becomes unsteady during playing, this immediately affects the pedal, resulting in the travel or inclination of the pedal becoming changed, making it impossible to optimally control performance. In this system the arrangement of the drum and the pedal is predetermined. The pedal can only be in contact with the drum directly, requiring the pedal to be located under the drum. Pressing the pedal releases the snare band, releasing the pedal causes tensioning the snare band. With any other pedal system such as e.g. for the base drum, hi-hat the sequence is the opposite, i.e. pressing the pedal causes contact to be made e.g. to the drum.

In the invention lift-off and tensioning is accomplished via a moving steel cable in a guide sleeve linear in a single axis. The motion occurs via a compression spring axially requiring a travel of maximum 10 mm to fully release the snare band from its tensioned condition, resulting in no radial stressing of the components and without requiring a linkage, thus practically eliminating wear and tear.

The control pedal has a counter-spring storing the momentum resulting in performance to be instantly made available as soon as the pedal is released. This results in the snare carpet being very quick to retract, permitting very fast and controlled performance.

With LR, drum and control pedal can be located totally independently. The steel cable is movingly guided in a guide sleeve, resulting in the distance between drum and pedal always remaining precisely the same, no matter where the pedal is located, whereas the length of the cable is variable and can be determined by the drummer.

Removing the controller from the three-stage automatic system is quickly done with no problem simply by turning an eccentric lever through 90°. Control pedal and controller form a compact unit easily stowed and transported e.g. in a gig bag.

Fitting the controller is both simple and speedy for anyone to do by mounting the control member on the three-stage automatic system, it also being possible to adjust the position and level of the control member to individual requirements.

The motion sequence of the system in accordance with the invention is the same as in conventional drum systems, i.e. pressing the control pedal tensioning the snare band. The drummer can thus integrate this system with the other drum pedals.

Apart from this, the control pedal and controller can also be used in muting horns, i.e. in providing continuously variable control of the mute, be it inserted or clipped on, by the combination of the controller, control cable guide sleeve leading to the foot control pedal in accordance with the invention. This thus makes it possible for the horn player to keep both hands on his instrument in fully concentrating on his performance whilst nevertheless being able to actuate the mute quickly and simply adjustable by means of the continuously variable controller.

The system in addition makes it possible to produce an effect bass drum by equipping a snare drum with lift-off and control on both heads, ensuring lift-off perfectly in parallel used in conjunction with a bass drum. In this arrangement two steel cables in a guide sleeve lead from the bass drum to a control pedal enabling the drummer to play the bass drum effect continuously variable or also with a continuous snare carpet ON/OFF by means of the foot control (foot-lockable control pedal).

The invention comprises furthermore a throw-off including a snare band changer which now makes it possible for the drummer to prepare and change the snare bands in a matter of seconds.

In one variant of this system the carpet clip tension head can be removed from a spindle to dismantle the snare band together with the carpet clip tension head simply by finger pressing two small levers together without the need of a tool. When fitting the snare band to the spindle the drummer simply needs to axially push the two carpet tension heads on the spindle.

In another embodiment, for example when the snare band porting of a drum is dimensioned smaller, the snare band is secured to two very thin adapters (e.g. 1 mm thick) enabling the snare band including the adapters to be threaded through any snare band opening.

When already prepared, the snare band with the adapters can be slotted in place as provided for in the carpet tensioning clip head and push-locked in place. Changing the snare band is done by means of a pushbutton enabling the adapter to be pulled out of the carpet tensioning head for removal of the complete snare band including adapter from the drum.

With the aid of a snare band carrier snare bands can be prepared in the required length, instantly ready for use, when needed, without any readjustments or changes in a snare band lift-off mechanism. This snare band carrier now assures, when correctly put to use, precise snare band lengths being made available.

The carrier consists of a guide rule with 1 mm scale divisions, a fixed tensioning head and a vernier longitudinal movable tensioning head which can be locked in place.

The vernier movable tensioning head is moved and locked to the required length, the adapters then inserted in both tensioning heads which, the same as in snare band lift-off, automatically lock safely in place, after which the snare band can be fitted to the adapters with no change in length. There is also the possibility of removing the snare band fitted to the drum for use as a sample length, resulting in a snare band precisely the same in length.

It is understood that patenting is claimed for all features described both singly as well as in any possible combination.

BRIEF DESCRIPTION OF THE FIGURES

Further features and advantages of the invention read from the following examples of embodiments as shown in the Figs., in which.

DESCRIPTION OF PREFERRED EMBODIMENTS

Figure 1:
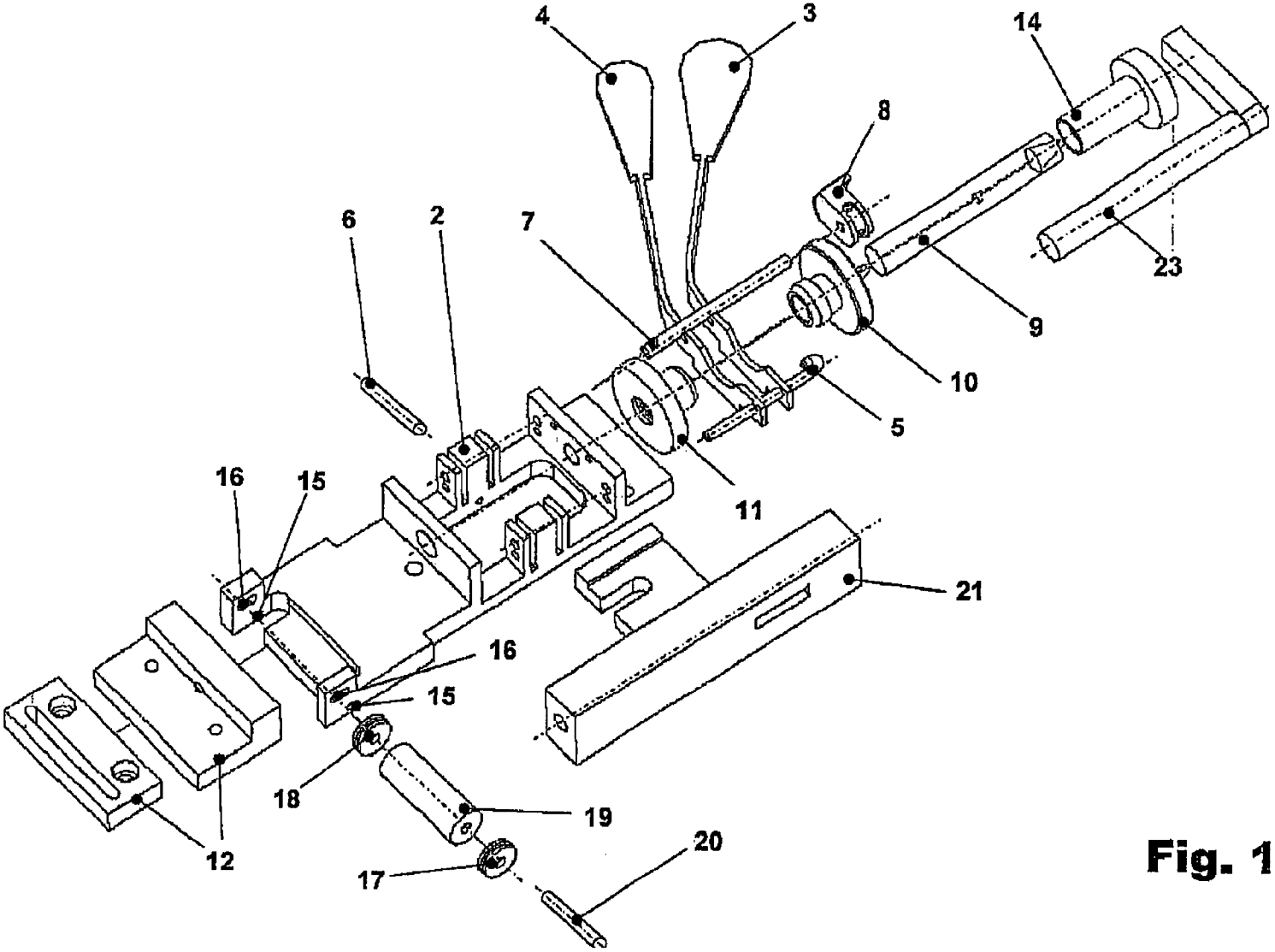
FIG. 1 is an exploded view of a three-stage automatic system of the device in accordance with the invention.
Figure 2:
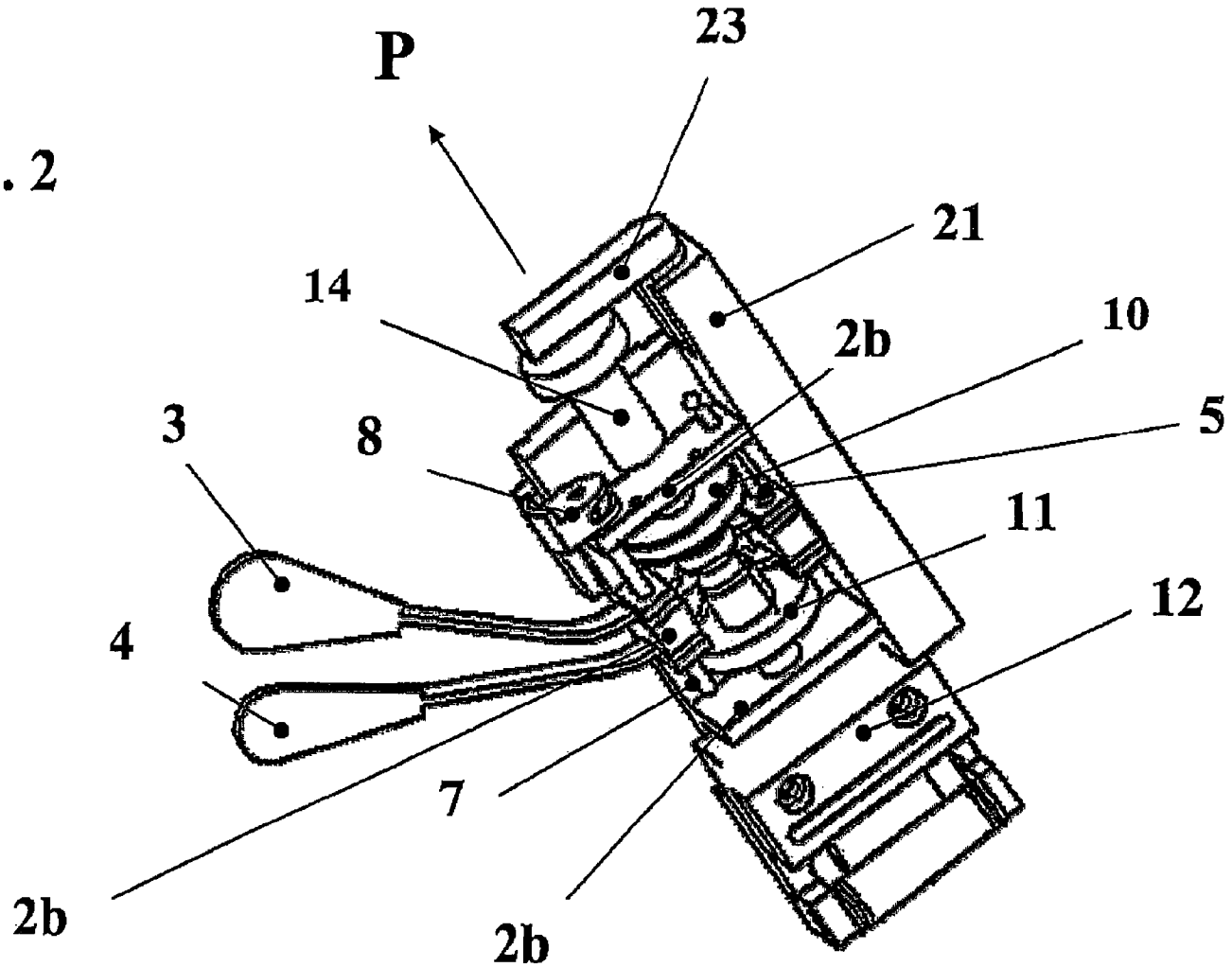
FIG. 2 is a view in perspective of a three-stage automatic system of the device in accordance with the invention.

Referring now to FIG. 1 there is illustrated an exploded view of a three-stage automatic system of the device in accordance with the invention, whilst FIG. 2 illustrates an assembled three-stage automatic system.

The three-stage automatic system comprises a base member 2 held in place by a screw on a guide part (not shown) whose position below the base member 2 is identified by the reference numeral 1. Backing off the screw enables the base member 2 to be continuously varied in a certain portion on the guide part. Tightening the screw relocks the base member 2 on the guide part. This is how the basic adjustment of the carpet spacing from the drum is done, as is variable at any time.

Figure 3:
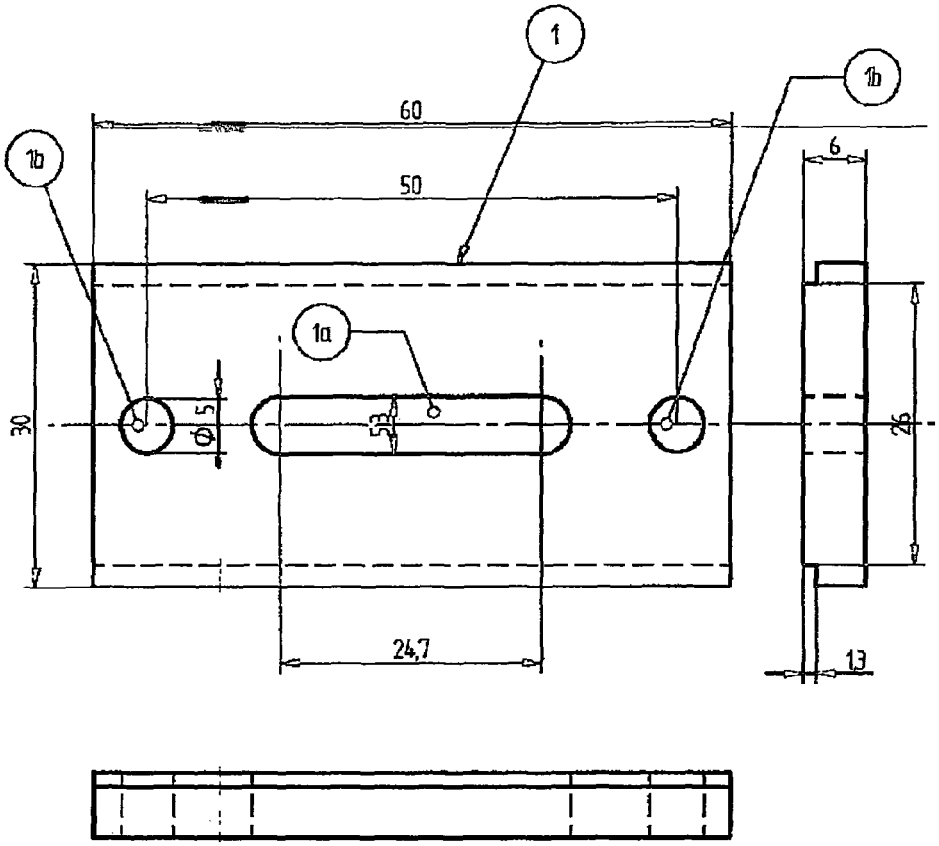
FIG. 3 is an illustration of various views (top-down view, longitudinal section view) of a guide part for the three-stage automatic system.

Referring now to FIG. 3 there is illustrated how the guide part 1 features a longitudinal slot 1*a* and drilled holes 1*b*. The guide part 1 is secured to the drum adapter by means of two screws.

Figure 4:
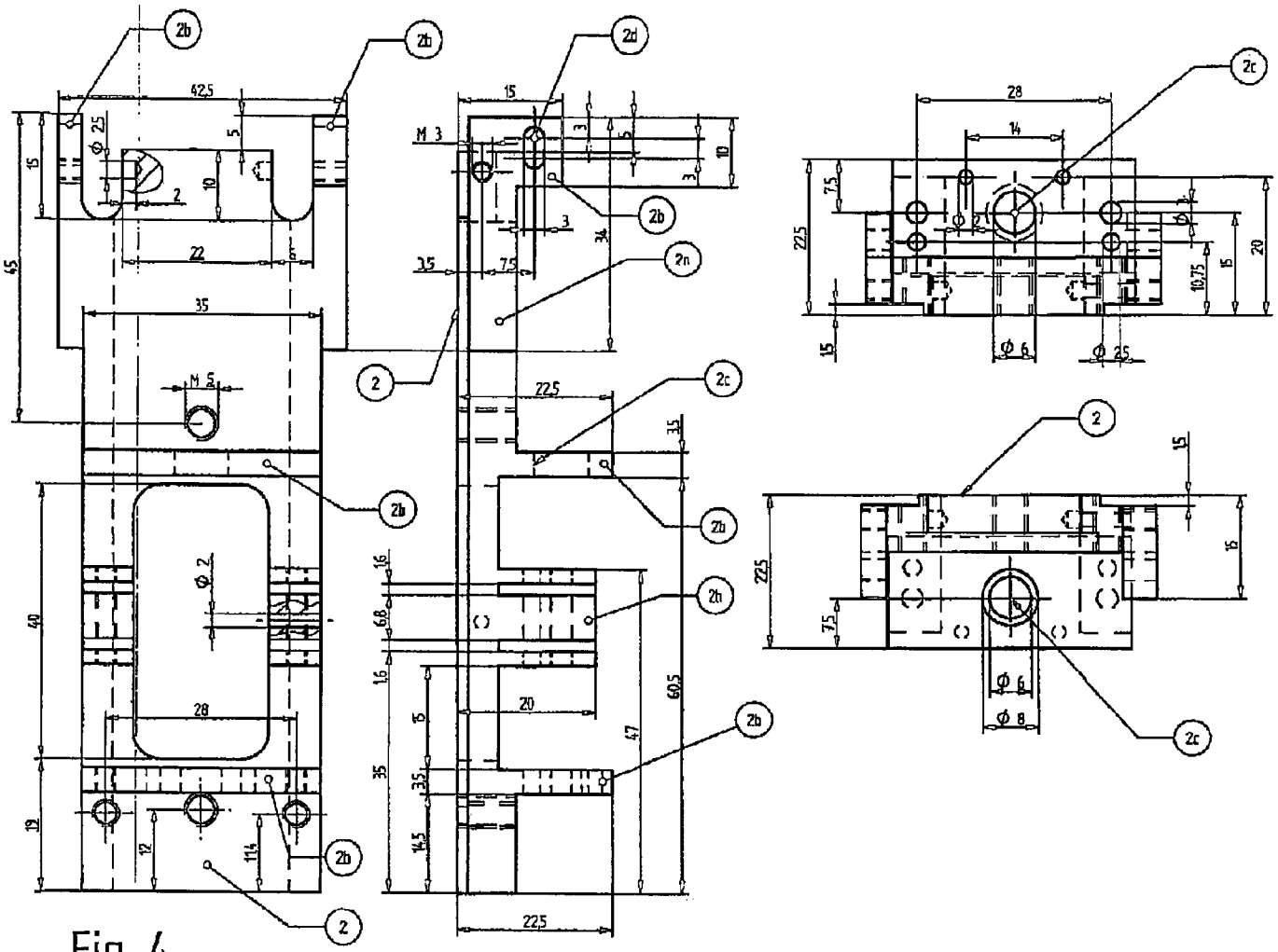
FIG. 4 is an illustration of various views (longitudinal section view, top-down view, cross-sectional view) of a base member of the three-stage automatic system.

Referring now to FIG. 4 there is illustrated how the base member 2 comprises a base plate 2*a* and webs 2*b* provided with concavities and/or drillings 2*c* for guiding, adapting, fitting or connecting further components of the three-stage automatic system. Longitudinal slots 2*d* are configured sideways.

Reference numerals 3 and 4 (see FIGS. 1 and 2) identify actuating (locking) levers rotatably mounted in the base member 2 and arranged at a spindle which is arranged at the base member 2.

Figure 5:
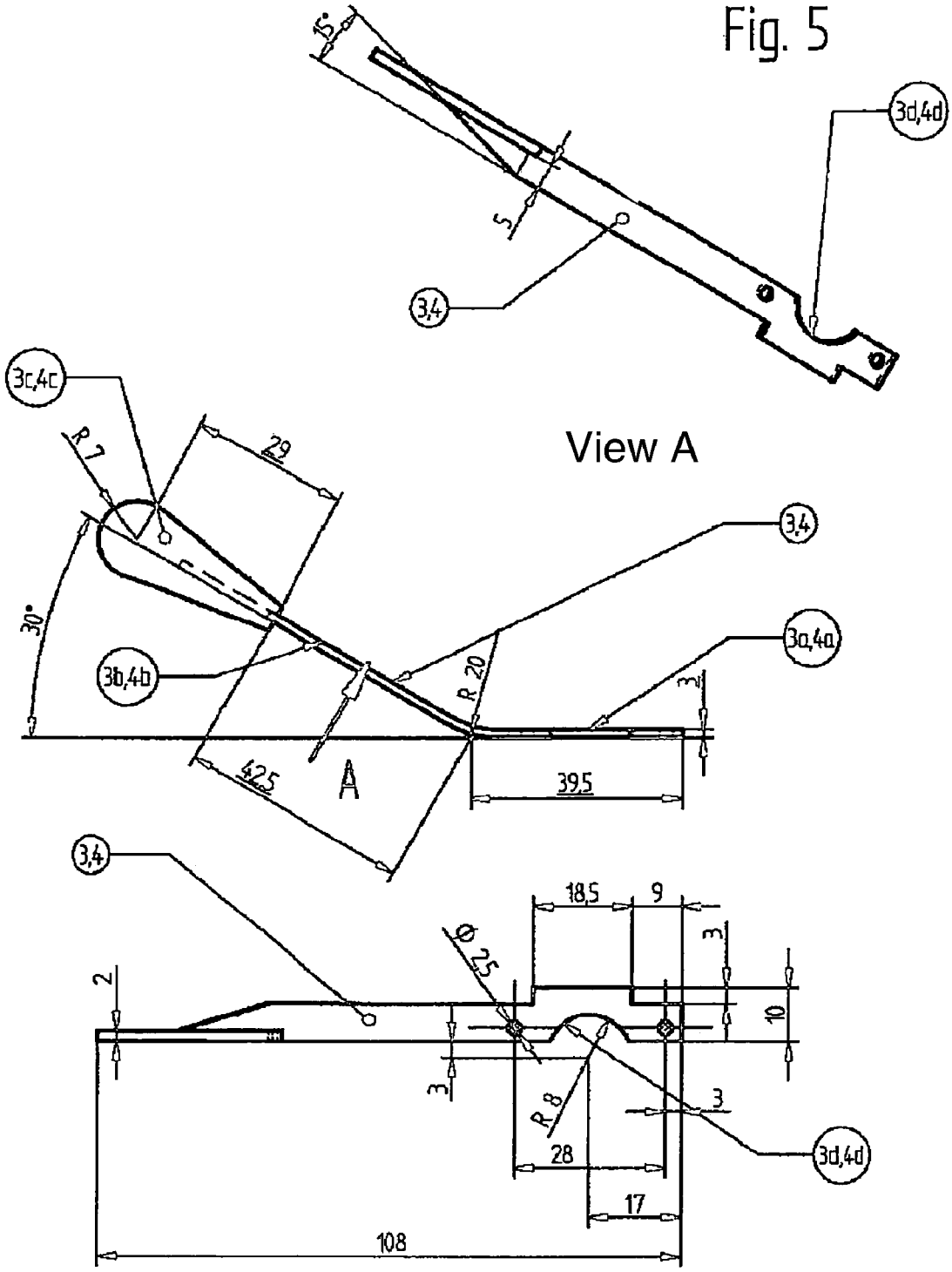
FIG. 5 is an illustration of various views (side view, top-down view) of an actuating lever.

Referring now to FIG. 5 there is illustrated the fastening levers 3, 4 in detail. Each lever 3, 4 comprises a base member 3*a*, 3*b* with concavities 3*d*, 4*d* adapted to a positioning spindle 9, a lever arm 3*b*, 4*b* and a button 3*c*, 4*c*.

Figure 6:
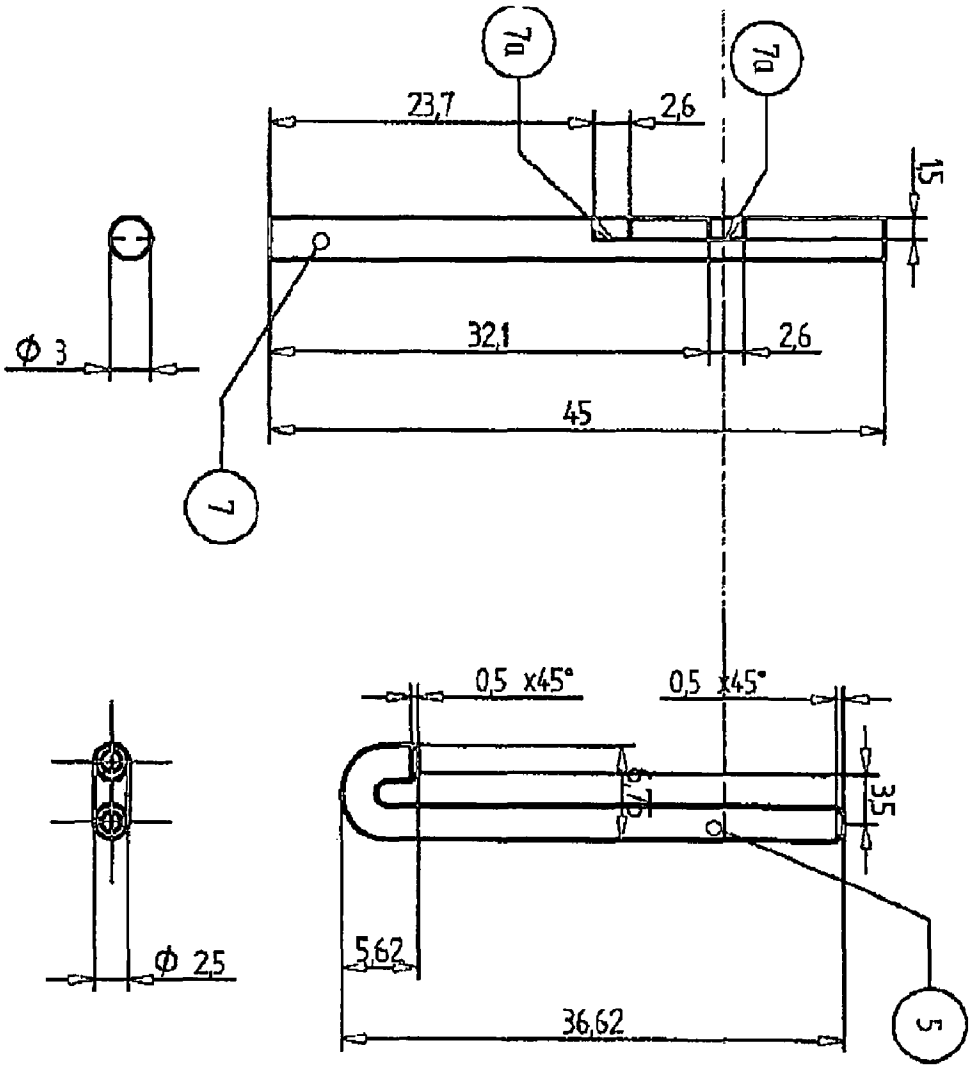
FIG. 6 is a top-down view of a spindle.

Referring now to FIG. 6 there is illustrated how a spindle 5 or a preplug and an inserted torsion spring 6 provide the actuating levers 3 and 4 with the necessary counter-pressure.

Figure 7:
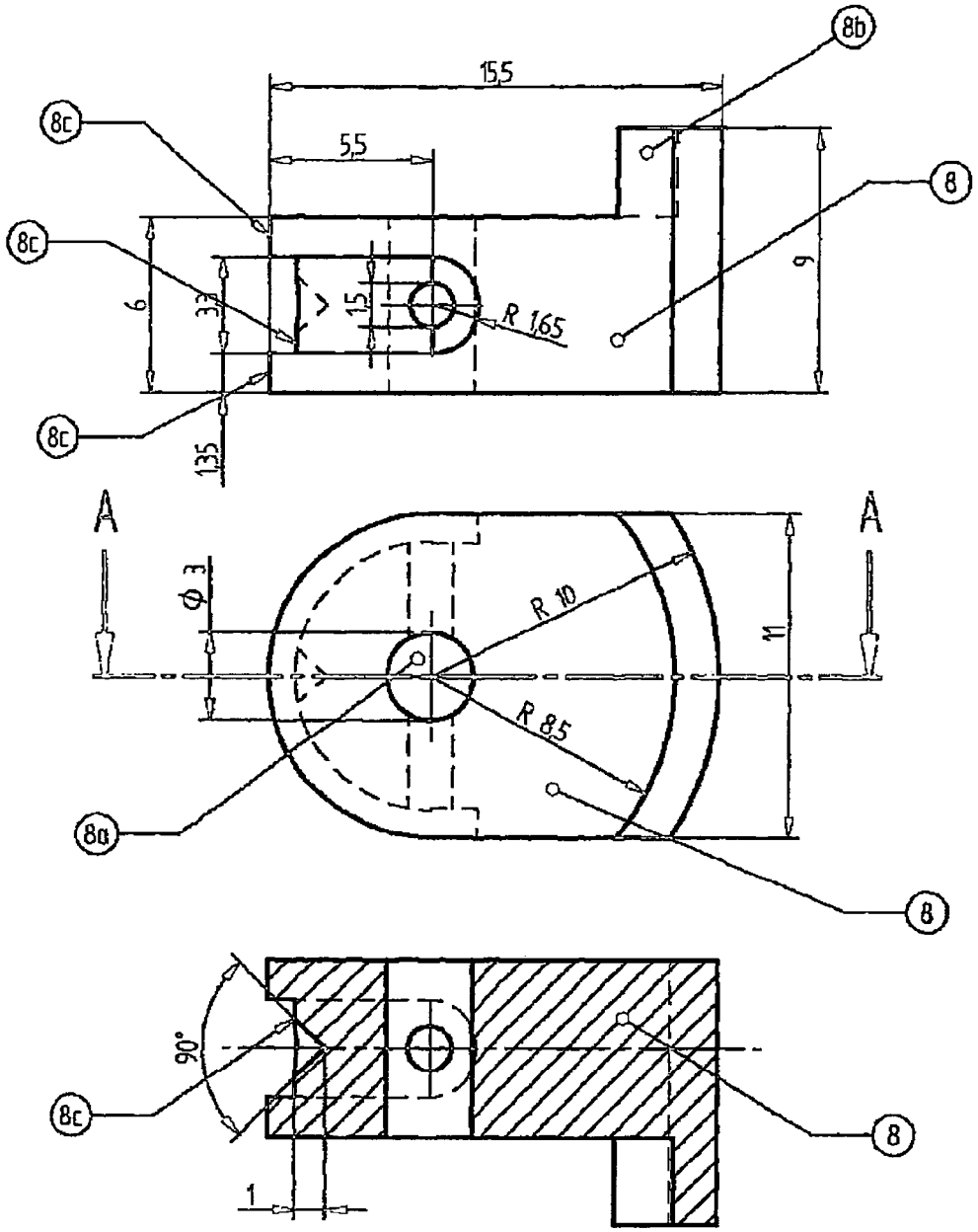
FIG. 7 is a view of a control pedal and various views (top-down view, side section view) of an ON/OFF rotary knob.

Referring now to FIG. 7 there is illustrated how an insertable locking unit 7, 8 (control pin 7, ON/OFF rotary knob 8) can be turned through 90° between various positions, resulting in the actuating levers being eccentrically stressed. In the closure position both levers 3, 4 are forced downwards. The control pin 7 comprises recesses 7*a* lengthwise spaced away from each other with the same spacing of the levers 3 and 4 in the fitted condition. The control pin 7 engages in an opening 8*a* provided in the ON/OFF rotary knob 8. In addition, the ON/OFF rotary knob 8 features a concave projection 8*b* and convex edge surfaces 8*c*.

Figure 8:
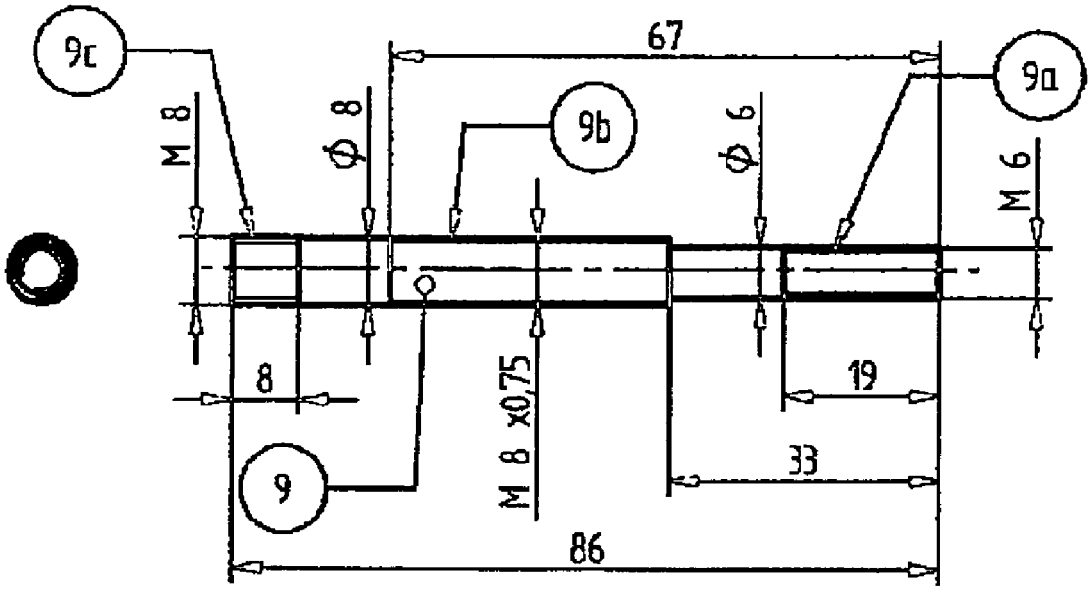
FIG. 8 is a side view of a positioning spindle.

Referring now to FIG. 8 there is illustrated a positioning spindle 9 machined with a M6 thread 9*a* onto which a setscrew 14 is screwed. The M6 thread 9*a* makes a portion available for setting the spring pressure, i.e. by adjusting the setscrew 14 the contact pressure of the snare band on the drum can be predefined as a maximum. At a M8 threaded portion 9*b* machined on the positioning spindle 9 two setscrews 10 and 11 are applied. The M8 fine thread 9*b* determines the range in which the stage automatic system can be set. A further portion having a M8 thread is a thread 9*c* for fastening the carpet fastener head. The positioning spindle 9 is guided through openings 2*c* provided for this purpose in the webs 2*b* of the base member 2. Moving the positioning spindle 9 axially alters the contact pressure of the snare band on the drum.

Figure 9:
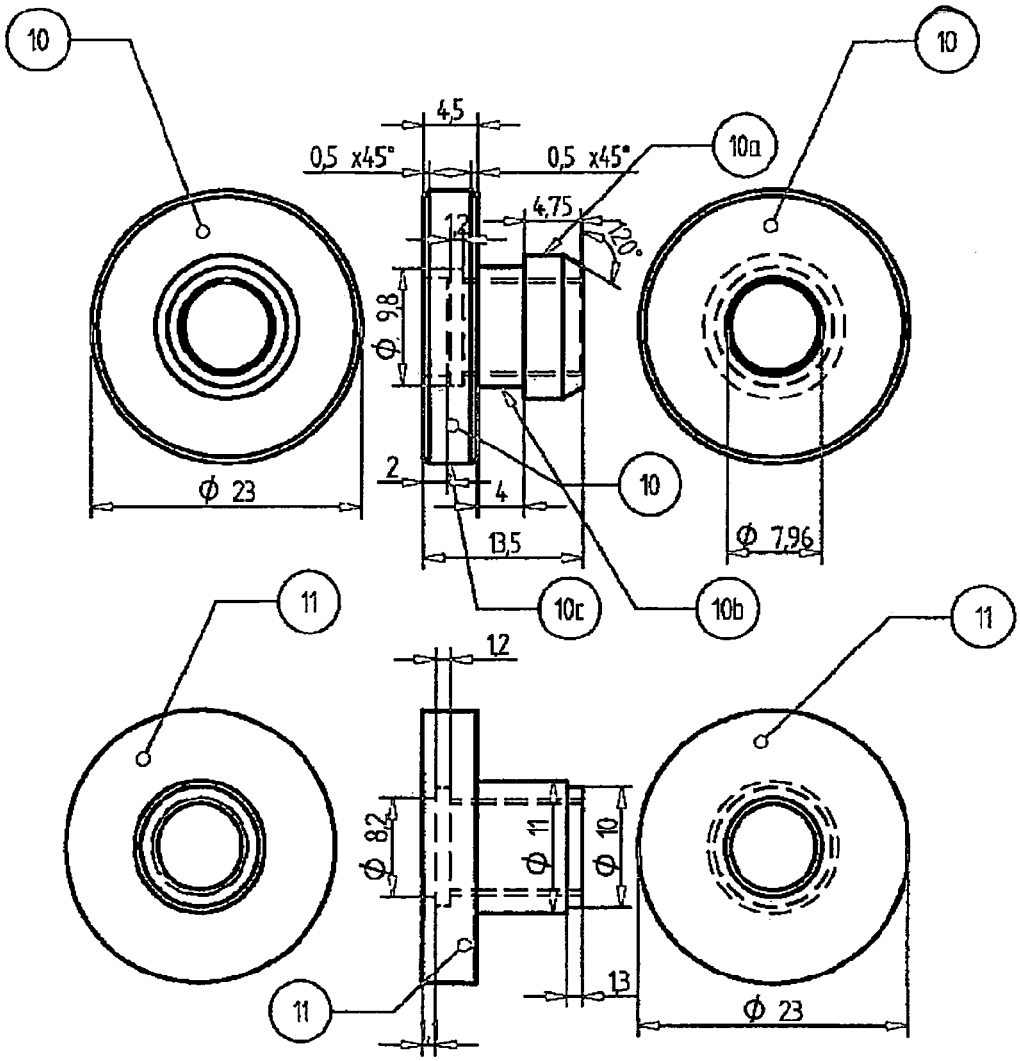
FIG. 9 is an illustration of two views of knurled positioning setscrews

Referring now to FIG. 9 there is illustrated knurled setscrews 10 and 11 to be fixed to the portion 9*b* machined with a M8 thread in a predetermined sequence. Outwardly the screw 10 is structured axially with protuberances 10*a*, 10*c* and a recess 10*b* disposed therebetween.

Figure 10:
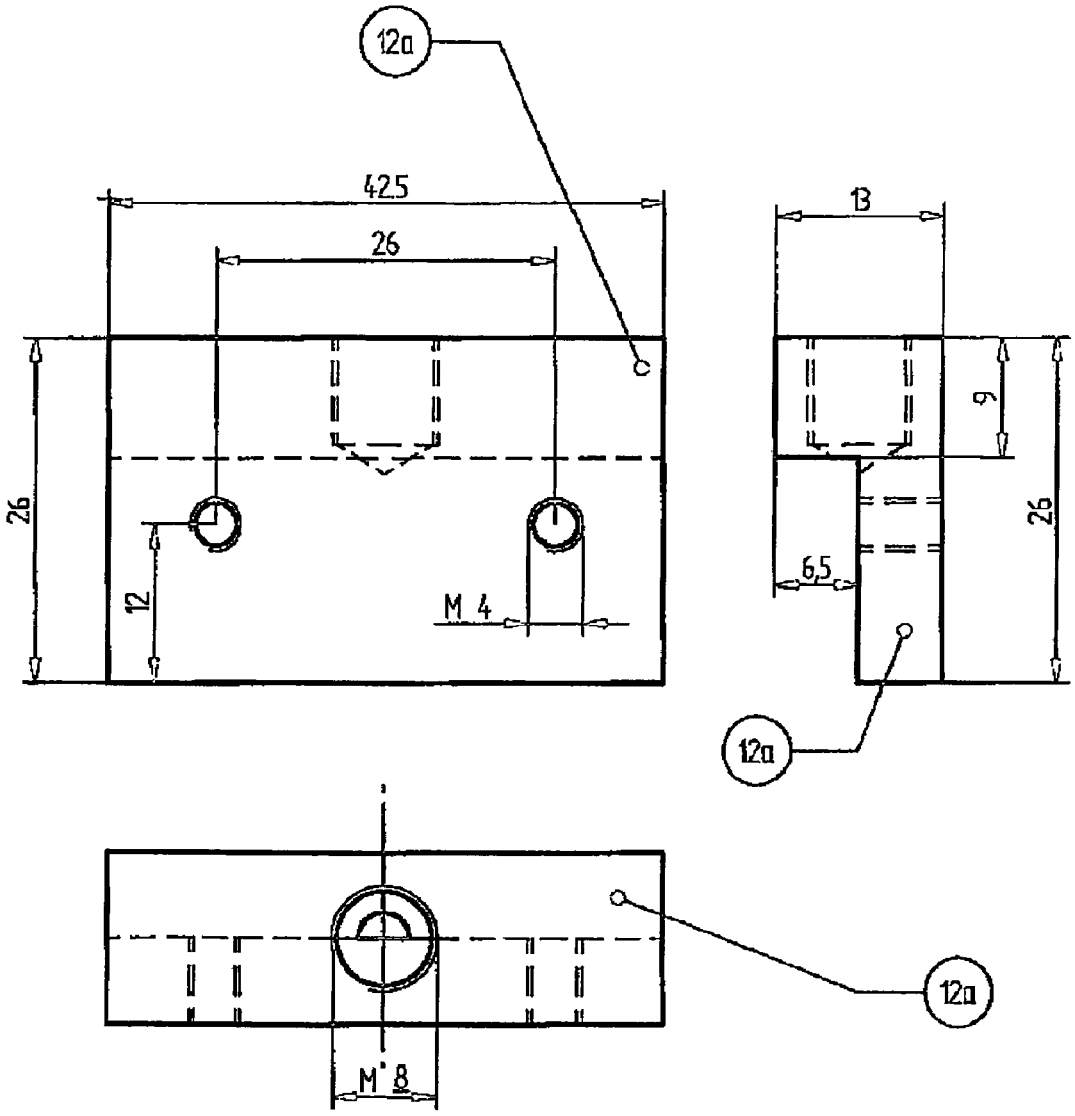
FIG. 10 and FIG. 11 illustrate of various views (top-down view, section view) of the carpet tensioning part.
Figure 11:
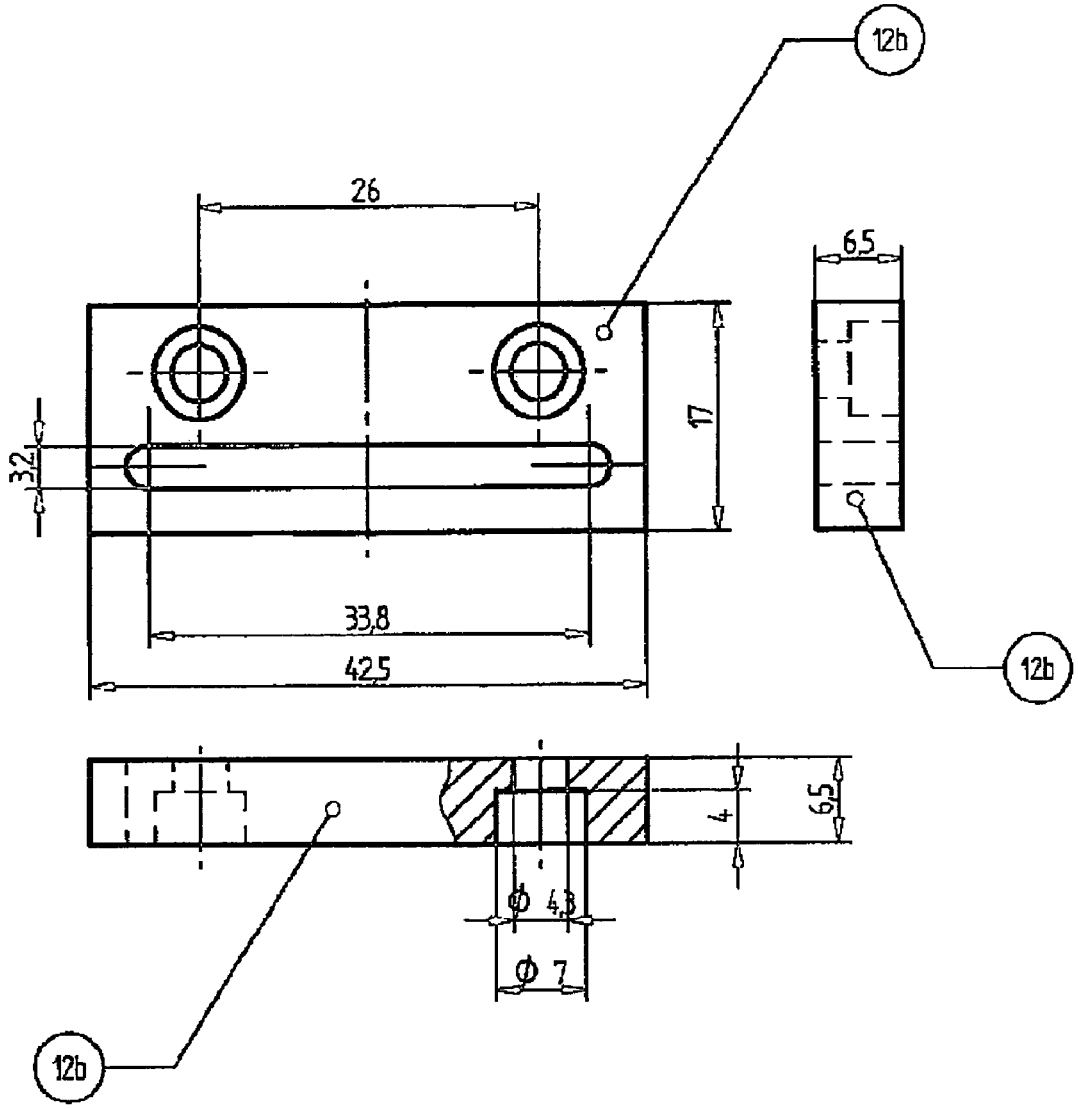

Referring now to FIG. 10 or 11 there is illustrated how the carpet tensioning head 12 comprises two clamping parts 12*a* and 12*b*. The carpet tensioning head 12 is clip-fastened to the spindle 9 and arranged on the base member 2 as shown in FIG. 2.

Figure 12:
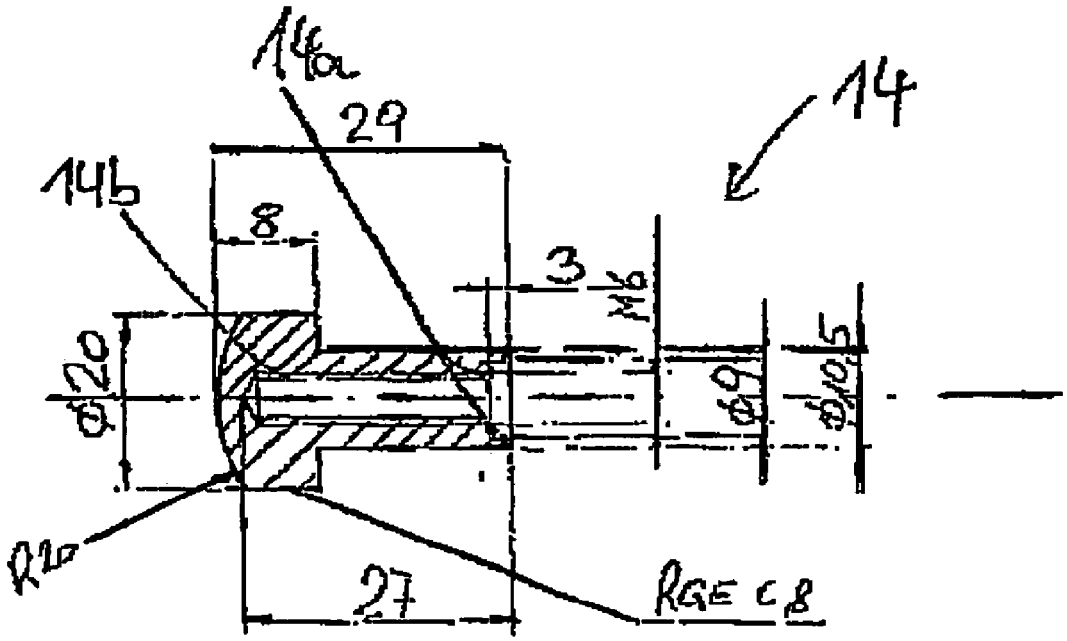
FIG. 12 is a longitudinal section view of a compression screw.

Referring now to FIG. 12 there is illustrated how at the side facing away from the carpet tensioning head 12 a compression spring is arranged at the position identified by reference numeral 13 which is tensioned by means of the compression spring 14 in relation to the base member 2. The compression spring is in contact with a ring stop 14*a* of the compression spring 14. The compression spring at 13 generates a compression force exerted in the direction P (FIG. 2) which presses the snare band secured to the carpet tensioning head 12 against the drum. The compression screw 14 receiving the spring pressure P is screwed onto the spindle 9 by an M6 female thread 14*b*. Adjusting the compression screw 14 changes the contact pressure of the snare band.

A grub screw machined with an M3 thread is secured in an opening 15 in the base member 2 and fitted together with a torsion spring, itemized by reference numeral 16.

Figure 13:
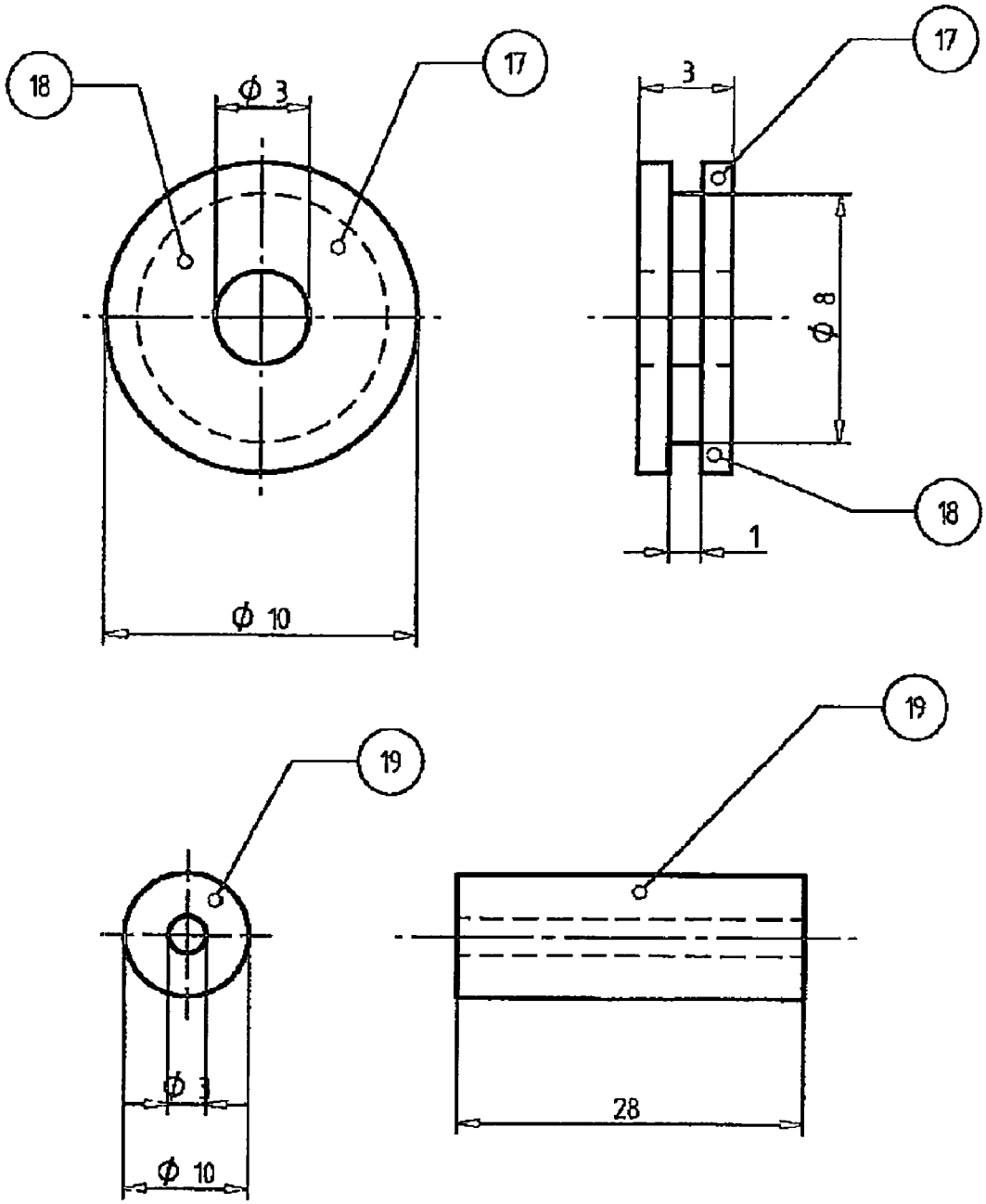
FIG. 13 is a top-down view of tensioning rolls.

Referring now to FIG. 13 there is illustrated how a spindle (separately itemized 20 at the bottom in FIG. 1) of 3 mm diameter is located in a longitudinal slot 2*d* provided in the base member 2, three tensioning rolls 17, 18 and 19 being arranged on the spindle 20 in a prescribed sequence. In addition, a torsion spring (itemized 16) clamps the tensioning rolls outwardly. These rolls 17, 18, 19 are provided to lift the snare band evenly from the edge of the drum.

Figure 14:
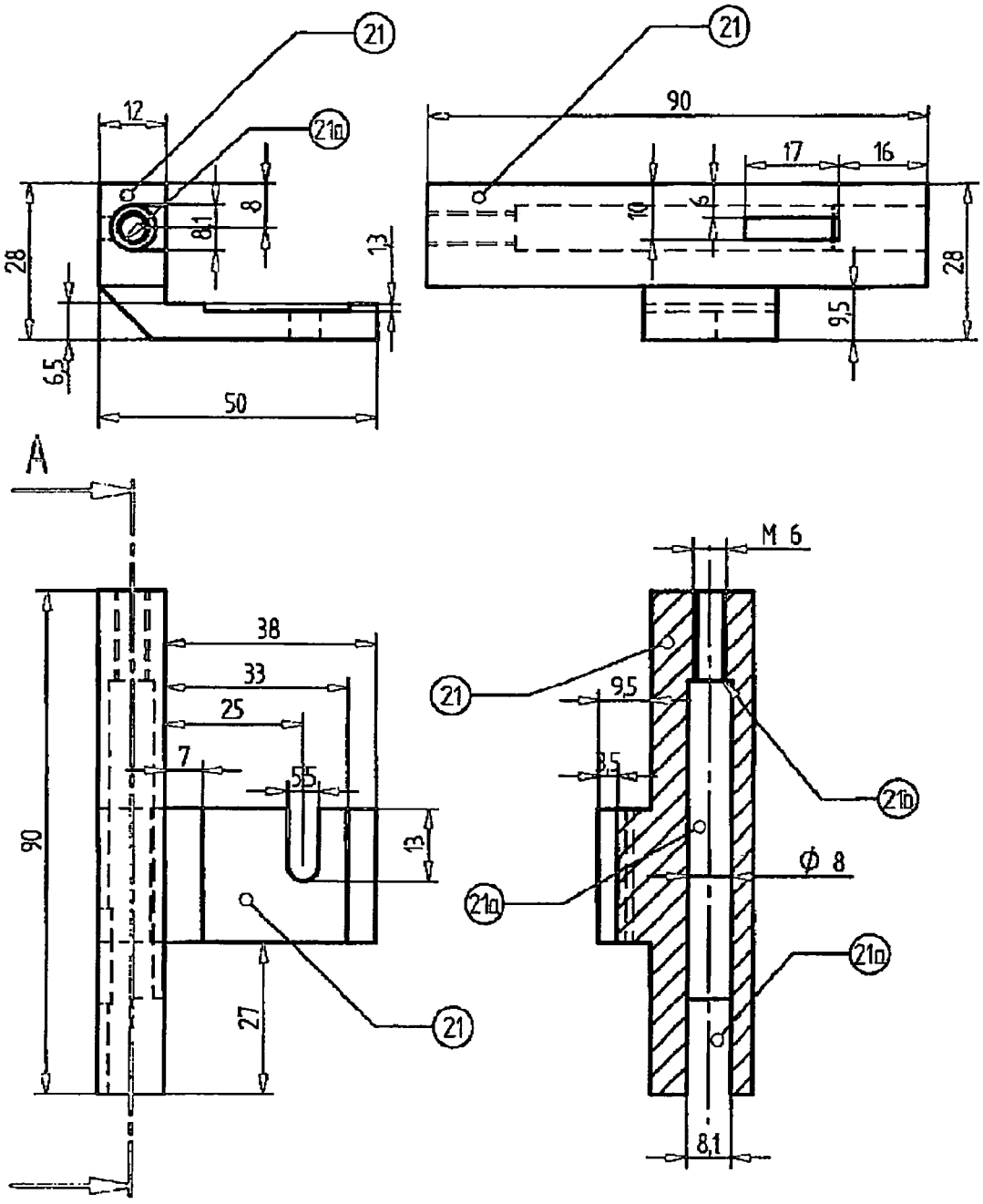
FIG. 14 is an illustration of various views (longitudinal section view, side view, cross-sectional view) of a lift-off device.

Referring now to FIG. 14 there is illustrated how a continuously variable adjustment with a foot pedal comprises furthermore a control member 21 (lift-off device) in the 8 mm drilling 21*a* of which a compression spring 22 is inserted. The compression spring 22 is in contact with the ring protuberance 21*b*. The control member 21 is secured to the base member 2.

The control lever 23 comprising a 2 mm drilling, is inserted into the opening 21*a*, it likewise contacting the compression spring 22 so that compressive stress is generated between the control member 21 and the control lever 23.

Figure 15:
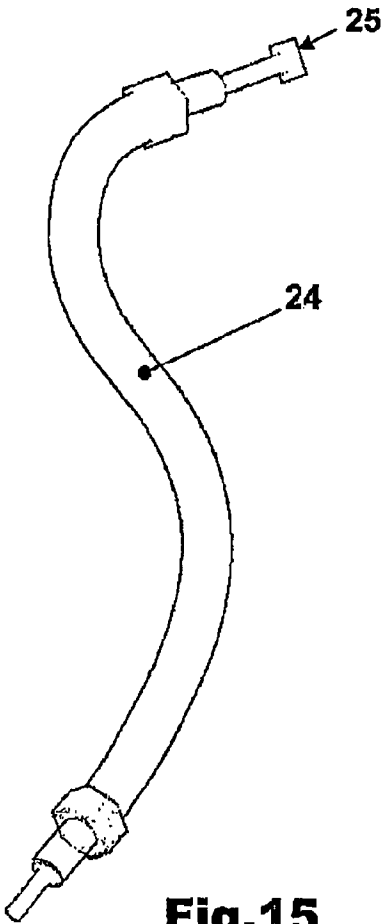
FIG. 15 is an illustration of a cable.
Figure 16A:
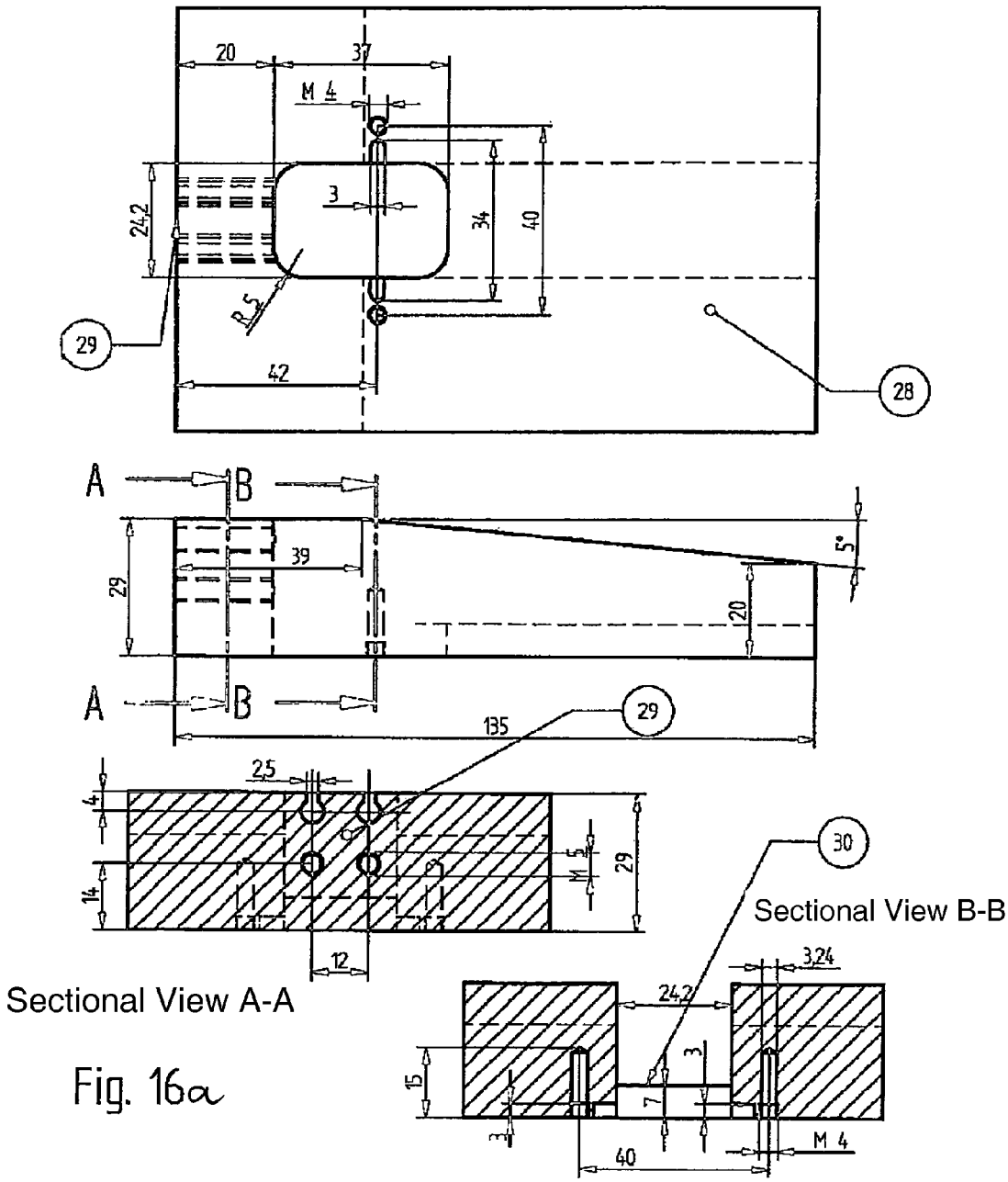
Figure 16B:
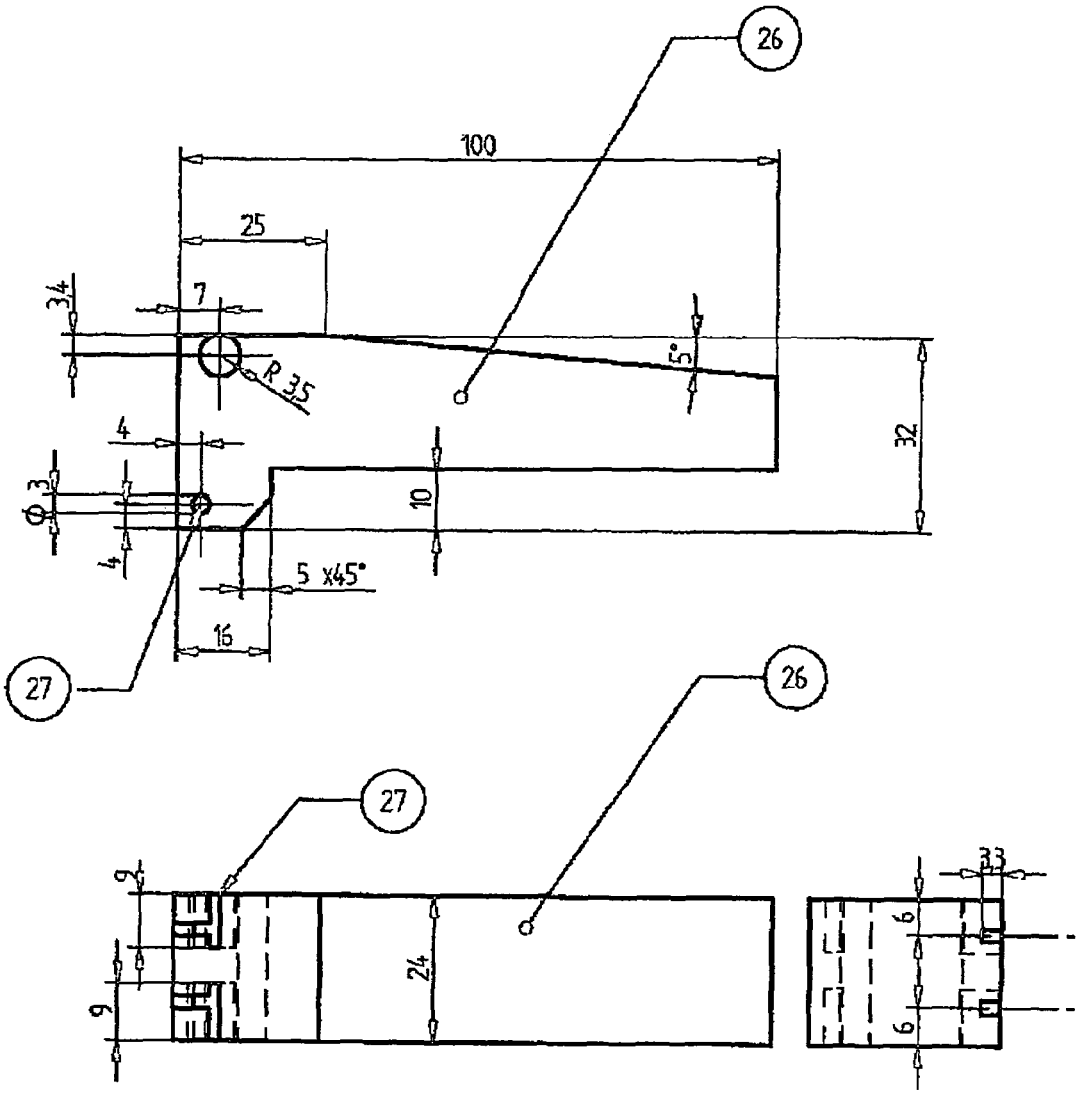

Referring now to FIG. 15 there is illustrated how a conventional control cable 24 is fully inserted into the 2 mm drilling in the control lever 23 and clamped in place by a grub screw. The cable changes the position of the control lever 23 in relation to the control member 21 (e.g. by means of a cable sleeve contacting the control member 21).

Figure 16:
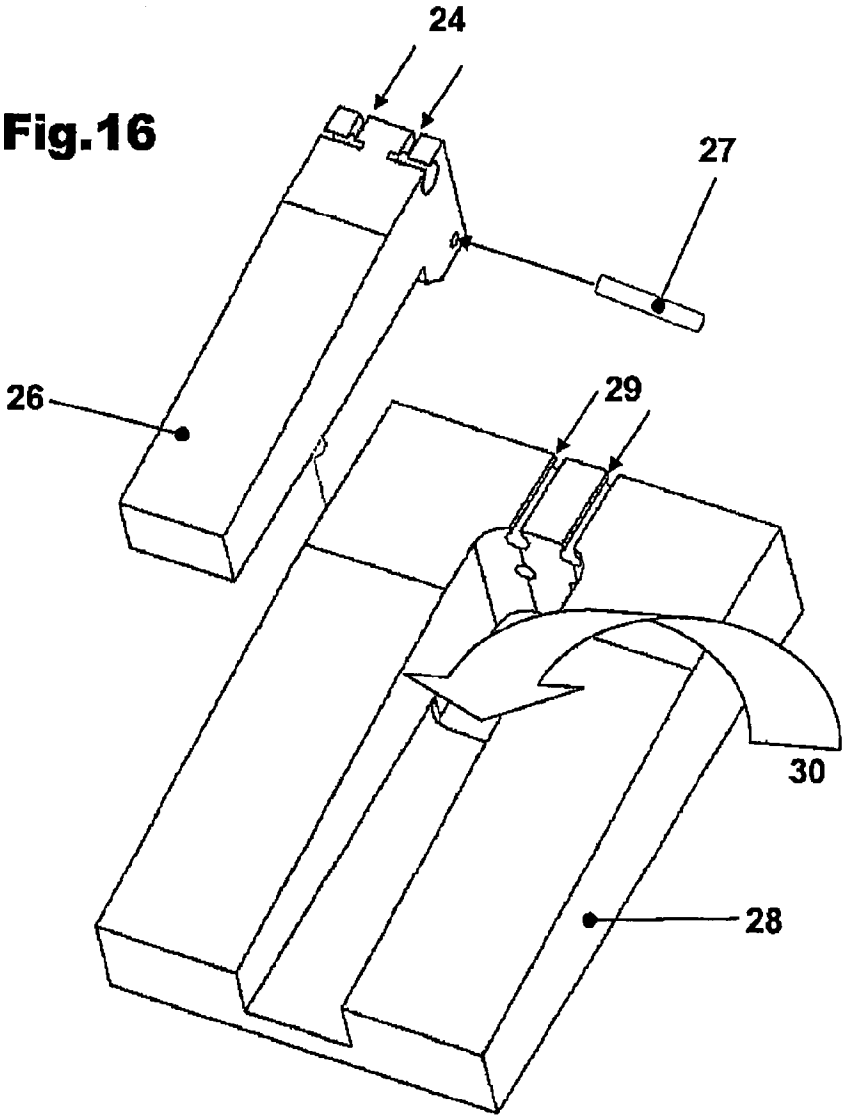
FIG. 16 is a view in perspective of a pedal actuator.

Referring now to FIG. 16 there is illustrated how the other end of the control cable 24 (nipple 25) is fitted in the drilling of a foot pedal lever 26 by positive insertion, the cable thus running from the control lever 23 through the opening 21*a* of the control member 21 to the foot pedal 26 or foot actuator 26, 27, 28, 29.

The positioning mechanism is operated via the foot pedal 26 and the cable 24 when the three-stage automatic system is adjusted in a state wherein the spacing of the snare band from the drum is continuously variable. The cable 24 runs through the control member 21 to the control lever 23. The tension in the cable determines the spacing between the control member 21 and the control lever 23 pretensioned by the compression spring 22. The control lever 23 or a stopper of the control lever 23 contacts, when actuated, the compression screw 14 connected to the spindle 9, moving it against the force of the compression spring 13 in a direction opposite to that of the spring pressure p, reducing the contact pressure of the snare band with the drum.

The foot pedal lever 26 with the control cable 24 secured thereto is guided through the longitudinal slot 30 in the pedal member 28 when fitted top-down. The foot pedal 26 comprises a drilling 27 of 3 mm diameter. Guided through the drilling 27 of the foot pedal 26 is a spindle. Lifting the foot pedal 26 lowers the 3 mm spindle in the pedal member 28 and is locked by two screws against leaving its prescribed position.

At 29 a limit screw is inserted and correctly positioned to set the lever travel in the pedal member 28. The setscrews on the control cable 24 are set so that the cable 24 is tensioned.

The control member 21 has continuously variable adjustment at the base member 2, it being set so that a wanted spacing, for example, approximately 1 mm, materializes between the spring pressure setting screw 14 and the control lever 23.

By means of the levers 3 and/or 4 the three-stage automatic system can be set so that the contact pressure of the snare band with the drum is continuously variable. The contact pressure is determined by the travel in actuating the foot pedal 26, correspondingly resulting in the control lever 23 urging the spring pressure setting screw 14, moving the spindle 9 in a direction opposite to that of the spring force P of the compression spring 13. It is in this way that the carpet tension is safely continuously variable.

The foot pedal means 26, 27, 28, 29, 30 is designed in this embodiment for two cables and correspondingly for two lift-off devices to lift-off the snare band from the drum the same at both ends.

Described in the following is an extended example aspect identified by new reference numerals. It is understood, however, that the composition and details of the components where obviously compatible with the example aspects as described hitherto apply likewise to the new embodiment.

Figure 17:
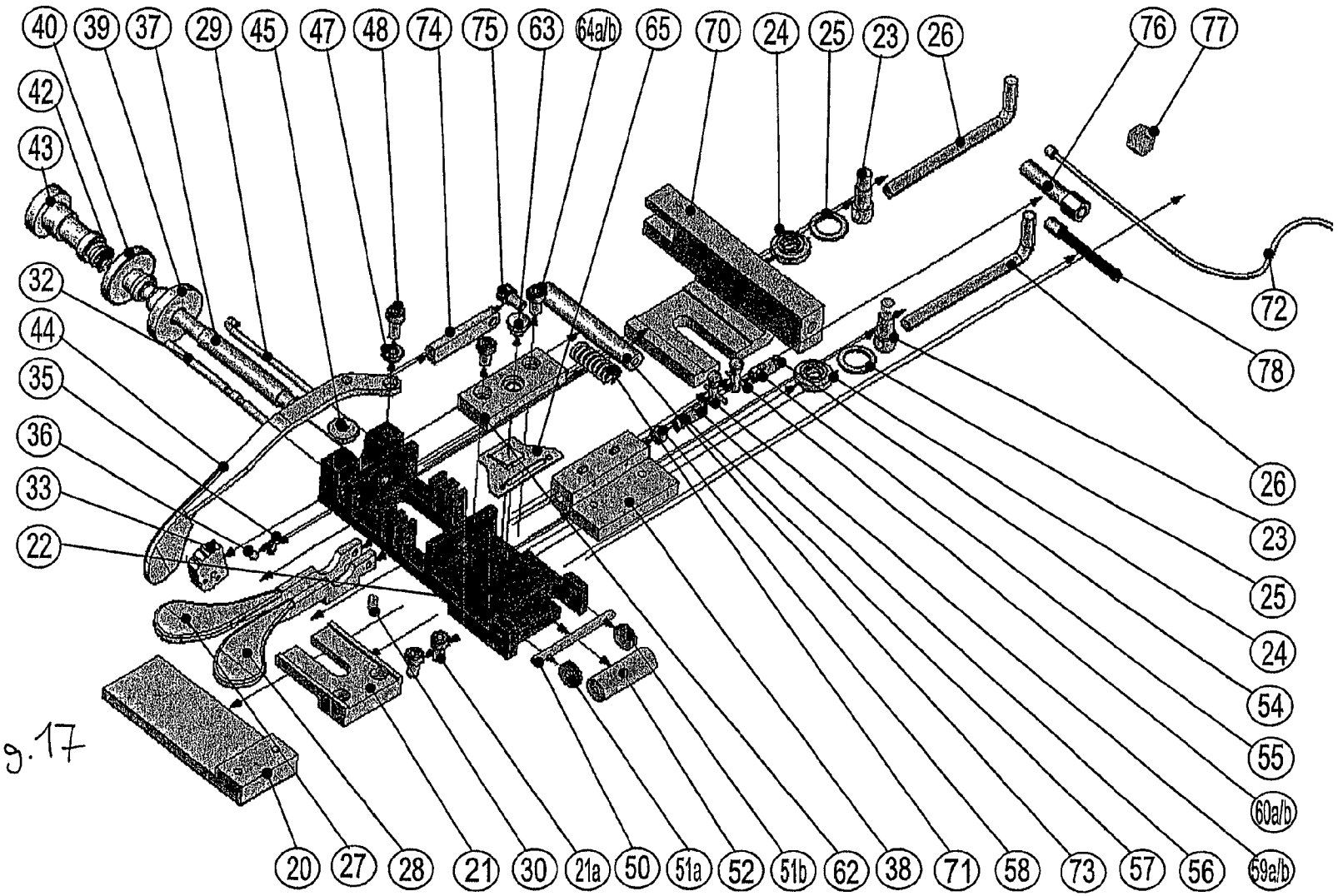
FIG. 17 is a further exploded view of part of the device in accordance with the invention.

Referring now to FIG. 17 there is illustrated in a further exploded view how part of the three-stage automatic system in accordance with the invention involves a drum adapter 20 and a guide part with a longitudinal slot 21 screwed together by screws 21*a*.

The base member 22 is clamped to the guide part 21 by means of an eccentric clamping fixture comprising a base clamping part 23, a spring washer 24, a base disk 25 and an eccentric lever 26 by turning the lever 26. In a certain range the base member 22 is provided linearly continuously adjustable, i.e. permitting a later fast basic setting of the carpet spacing as can be altered at any time. Turning the lever 26 through 90° or maximally 180° permits relocating the base member 22.

The actuating levers 27, 28 receive a fulcrum by insertion of a spindle 29 in the base member 22. Two compression springs 30 interposed between the actuating levers 27, 28 and the base member 22 urge the actuating levers 27, 28 away from the base member 22.

An insertable locking shaft 32 machined with two flats is inserted top-down through a 3 mm drilling into the base member 22 where it is simultaneously guided by a knurled locking wheel 33 until the flats of the locking shaft 32 are level with the actuating levers 27, 28. After this the knurled locking wheel 33 can be fixedly located at the locking shaft 32 by means of a grub screw 34. The locking shaft 32 can be turned through 90° resulting in an eccentric effect on the actuating levers 27, 28, both actuating levers 27, 28 being moved in the direction of the base member 22 in overcoming the force applied by compression springs 30. The knurled locking wheel 33 may latch in place by a spring 35 and steel ball 36 mechanism in two positions to exclude any wrong positioning of the locking shaft 32.

A spindle 37 has a threading for setting the carpet tension in the upper portion, a fine threading for setting the three-stage automatic system in the middle portion of the spindle 37 and a notch in the lower portion of the spindle 37 for fixing the clip head 38 in place. The spindle 37 is guided through the drillings in the underside of the base member 22 and simultaneously guided through the two setscrews 39, 40 as well as through the upper drilling in the base member 22. Via the threading in the upper portion of the spindle 37 a compression spring 42 is set until it comes into full contact with the base member 22.

A setscrew 43 is then screwed onto the threading for setting the carpet tension of the spindle 37, resulting in the compression spring 42 being compressed between the base member 22 and the setscrew 43, automatically lifting the spindle 37 away from the base member 22 in the direction of the setscrew. This upwards controllable spring force is responsible for tensioning the carpet.

By means of a screw 48 a translation lever 44 including a guide roll 45 and a guide bush 47 is screwed to a web provided in the upper part of the base member 22, the guide roll 45 simultaneously positively engaging a groove provided circumferentially at the setscrew 43.

At the underside of the base member 22 a roll spindle 50 is guided into longitudinal slots provided therefore in the base member 22, and simultaneously the roll spindle 50 is guided through a first torsion spring, the guide rolls 51*a*, 52, 51*b* and a second torsion spring. A grub screw provided in the guide roll 52 locks the roll spindle 50 in place, preventing it from being displaced.

The two torsion springs urge the guide rolls 51*a*, 52, 51*b* downwards and outwards, respectively.

Figure 18:
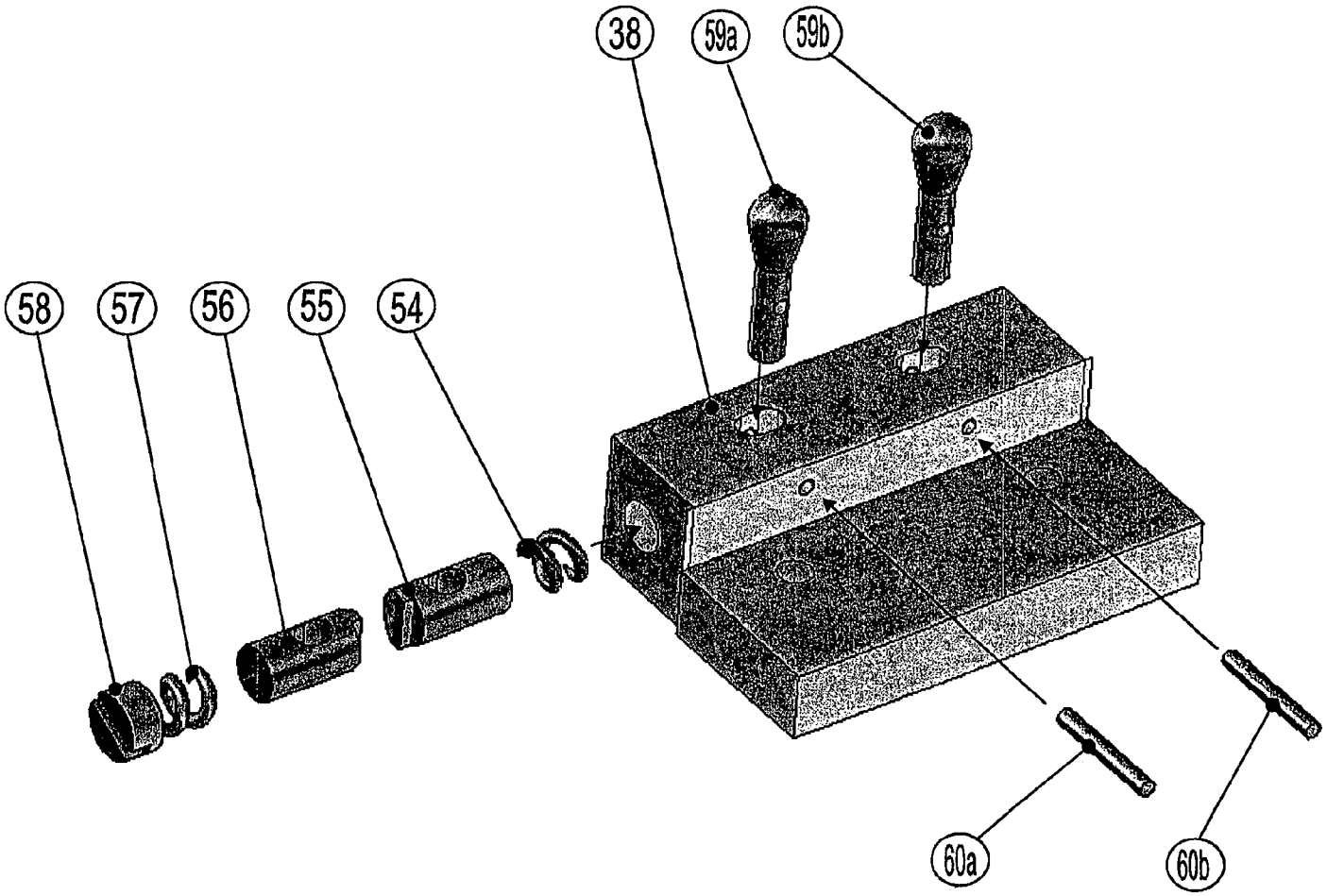
FIG. 18 is an exploded view of a clip system employed in accordance with the invention.

Referring now to FIG. 18 there is illustrated an exploded view of a clip head 38 in which a carpet band is clamped. The clip head 38 features a 5 mm horizontal drilling into which there are inserted, in this sequence, a compression spring 54, a first locating lug 55, a second locating lug 56 and a second compression spring 57, after. Then the drilling is closed off by a screw 58.

Moving levers 59*a*, 59*b* are inserted via two vertical drillings provided in the clip head 38 and the end of the moving levers 59*a*, 59*b* is inserted into vertical drillings provided in locating lugs 55 or 56, each of the locating lugs 55 and 56 featuring a longitudinal slot. Fitting two transverse pins 60*a*, 60*b* in the clip head 38 produces a fulcrum for each of the two moving levers 59*a*, 59*b*. Squeezing the two moving levers 59*a*, 59*b* together horizontal splays the two spring-loaded locating lugs 55 and 56 apart.

The assembled clip head 38 is mounted on the spindle 37, the two locating lugs 55, 56 automatically locked in place in the groove provided in the underside of the spindle 37. To release the clip head 38 the two moving levers 59*a*, 59*b* are squeezed together between two fingers to permit removing the clip head 38.

A clamping cover 66 having a longitudinal slot is screwed to the clip head 38 by two screws 21*a* to fixedly locate the snare band.

A further variant of a clip head 38 inserted in the embodiment as shown in FIG. 17, is particularly suitable for applications in which the carpet ports are maintained very close. With this clip system a cover plate 62 in which a pushbutton 63 is included, is screwed to the clip head 38 by screws 64*a*, 64*b*. A clip module 65 is then slided into the slot provided therefor in the cover plate 62, causing the upswept metal lip of the clip module 65 to positively lock in place in the cover plate 62. All that is needed to release it is to press the pushbutton 63 so that the clip module 65 can be extracted. The clip module 65 can be guided through any carpet port.

The cover plate is thus secured by a pushbutton. Provided between clip head and cover plate is a slot into which the adapter is slided to automatically lock in place. In other words, if the snare band port of a drum is structured smaller, in this variant the snare band is secured to two very thin adapters (1 mm thick), enabling the snare band including the adapter to be guided through any snare band port. This now makes it possible to prepare snare bands with adapters for a quick-change in a matter of seconds. The already prepared snare band and adapter is simply inserted in the slot provided for this purpose in the clip head, the adapter locking safely in place simply by lightly pushing it into place.

To change the snare band all that needs to be done is to press the head, enabling the adapter to be withdrawn from the clip head and the complete snare band including the adapter to be removed from the drum.

The controller, designed for smooth fitting, comprises a control member 70 (FIG. 17) featuring a drilling into which a compression spring 71 is inserted. After which, a steel cable 72 is inserted top-down through the drilling in the control pin 73 until its nipple positively contacts the steel cable in the control pin 73.

The control hook 74 is then screwed to the control pin 73 by means of a screw 75. Together with the control pin 73 screw mounting the control hook 74 the steel cable 72 is then inserted top-down into the 8 mm drilling of the control member 70, through the compression spring 71, through the lower drilling of the control member 70 and through the setscrew 76 screwed into the underside with a nut 77. A steel cable guide sleeve 78 is then applied to sheath the steel cable until the steel cable guide sleeve 78 comes into contact with the setscrew 76.

The steel cable 72 with its steel cable guide sleeve 78 leads to the foot control pedal.

Figure 19:
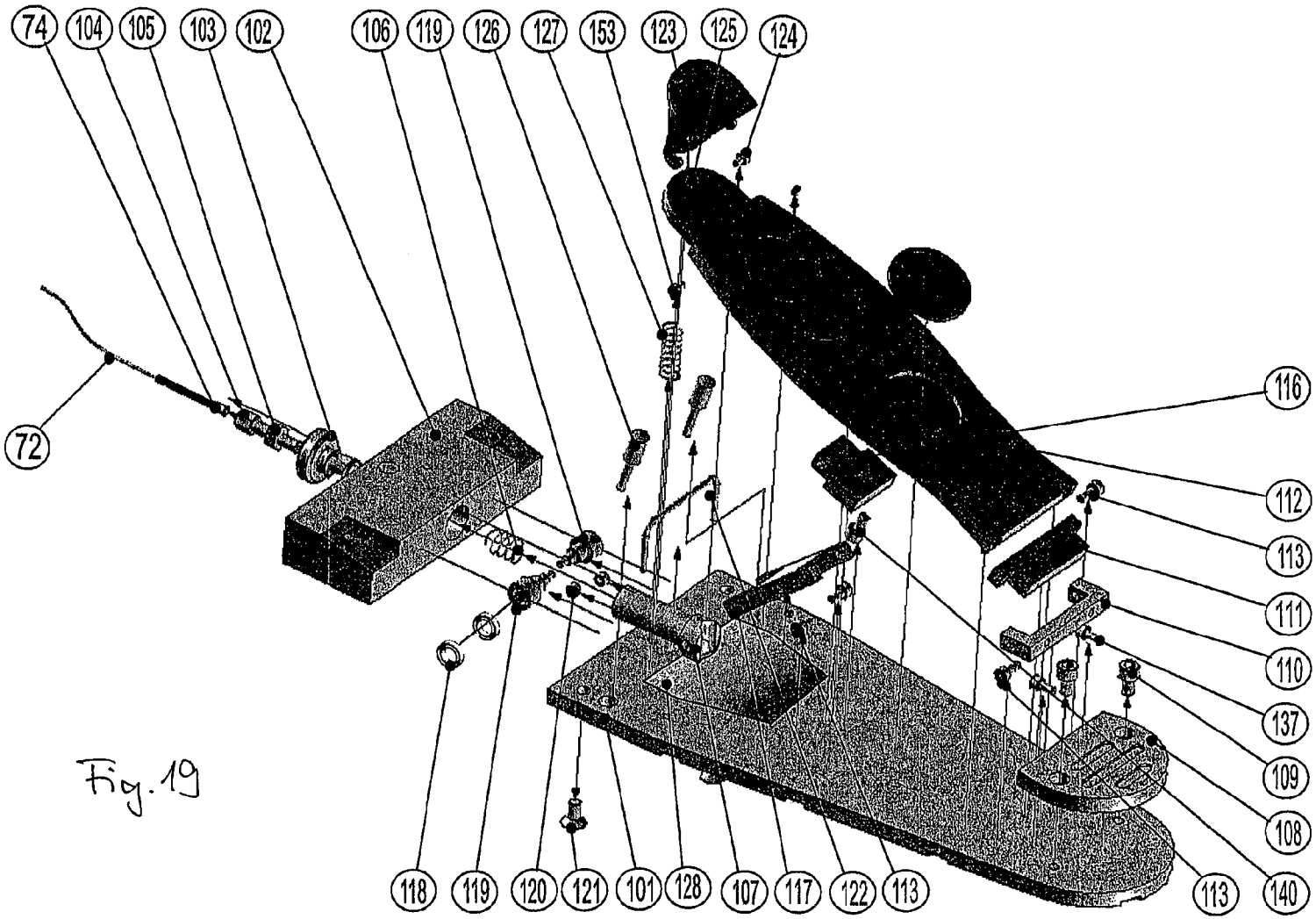
FIG. 19 is an exploded view of a first embodiment of a control pedal employed in accordance with the invention.

Referring now to FIG. 19 there is illustrated in an exploded view a first embodiment of a control pedal employed in accordance with the invention for the controller of the three-stage automatic system.

Shown is a control pedal for a hi-hat control cable. The control pedal comprises a base plate 1 made of aluminium antislip plate, criss-crossed 1 mm deep on the floor side and provided with a Velcro fastener. Bolted to the base plate 1 is a guide block 2.

A setscrew 4 featuring a locknut 5 is screwed into the guide block 2, it being through these elements that the steel cable 72, coming from the controller, is guided, until the steel cable guide sleeve 74 engages the setscrew 4.

Secured by the screws 9 to the base plate opposite the guide block 2 is a heel part 8. A first hinge part 10 is secured to the heel part 8. A second hinge part 11 is screwed to the underside of the control pedal 12. Both hinge parts 10, 11 are assembled and rotatably mounted by two screws 13.

Secured by a screw 80 to the underside of the control pedal 12 is a lever link, comprising a fixed part 16 and a movable lever 17, resulting in a fulcrum. The movable lever 17 features two drillings between which a roll 18 is fitted. The steel cable 72 coming from the controller is clamped to the movable lever 17 ahead of the roll 18 by means of a cable clamp 81 with screws 11.

Actuating the control pedal results in traction motion of the steel cable 72, drawing in the control hook 74 of the controller. An adjustable guide stopper 19 screwed to the base plate 1 by screw 82 sets pedal inclination. A compression spring 6 interposed between the control pedal 12 and the movable lever 17 ensures an elastic tension for lift-off of the control pedal 12.

A U-bolt 22 is mounted in two drillings in the guide block 2 and is secured in place by two screws. When the pedal is down to the floor a spring loaded control pedal locking flap 23 can be hooked into the U-bolt.

Fitted between the pedal 12 and the guide block 2 is a compression spring 27. A wear coating 28 to be located under the roll 18 is intended to permit movement at the surface of the base plate and to protect the surface.

This embodiment now makes it possible to use the control pedal to actuate the hi-hat via a cable guide sleeve and a controller for continuously variable stepless mounting on a hi-hat.

Figure 20:
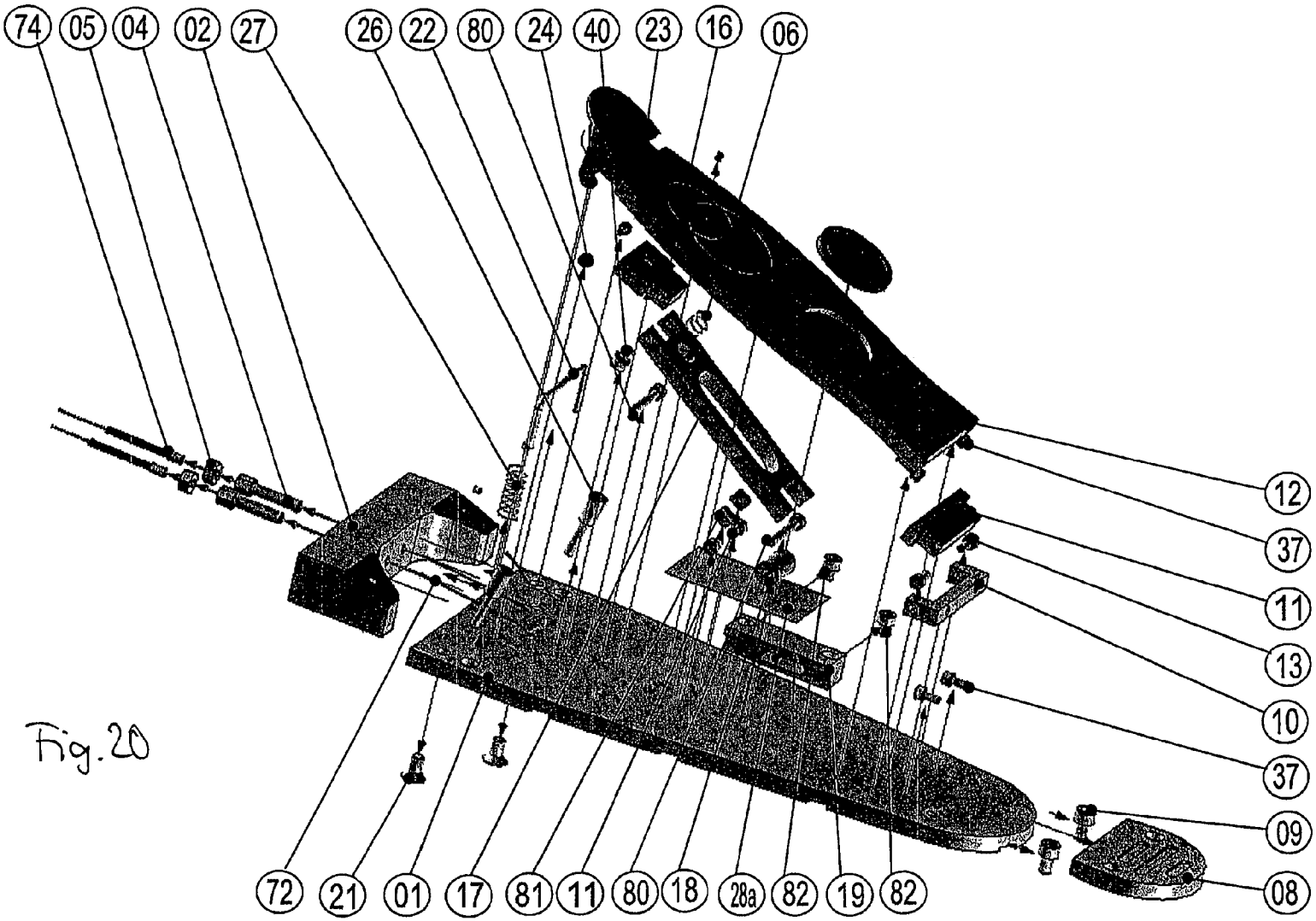
FIG. 20 is an exploded view of a second embodiment of a control pedal employed in accordance with the invention.

Referring now to FIG. 20 there is illustrated yet another embodiment of a control pedal in accordance with the invention.

Provided in this case is a base plate 101 made of aluminium antislip plate, criss-crossed 1 mm deep on the floor side and provided with a Velcro fastener. The guide block 102 is screwed to the base plate 101 by countersink screws 121. A setscrew 103 is screwed into the guide block 102, after which the setscrew 104 is bolted in place with locknut 105. The steel cable 72 coming from the controller is then guided through these elements until the steel cable guide sleeve 74 engages the setscrew 104. At the opposite side of the guide block 102 a slide mount bush and a compression spring 106 are fitted in the drilling. A control piston 107 features a small drilling through which the steel cable 72 is guided, after which the control piston 107 is inserted into the drilling of the guide block 102 and the steel cable 72 locked in place by means of a screw.

Screwed by screws 109 to the base plate 101 opposite the guide block 102 is a heel part 108. A torsion band 110 is secured to the heel part 108 by means of screws. The second part of the torsion band 111 is then screwed to the control pedal 112. Both torsion bands 110, 111 are assembled and rotatably mounted by two screws 113. Provided is a lever link consisting of a fixation part 116 fitted by screw **116*a* to the bottom of the control pedal 112, and a movable lever 117. The movable lever 117 comprises two drillings level with the drillings in the control piston 107. A guide mount 118 serving as aid to guide the control piston 107 is slipped onto the screw-in spindle 119 and threaded through the drilling of the movable lever 117 into the drilling of the control piston 107 in which a mounting bush 120 is located, and tightened. When the pedal is actuated the control piston 107 has linear movement in both directions in the guide block 102**.

A U-bolt 122 for hooking in place is inserted top-down into the two drillings in the guide block 102 and locked in place by two screws. This U-bolt 122 is height-adjustable as required.

Rotatably mounted in the foremost portion of the pedal is a locking flap 123 by means of two screws 124, a compression spring 125 providing the necessary counter-pressure of the locking flap 123. Two knurled setscrews 126 are configured tipped for screwing into the guide block 102 at a certain inclination to prevent the base plate 101 from slipping out of place.

Interposed between the guide block 102 and the control pedal 112 is a compression spring 127 producing a counter-pressure in the lower portion when the control pedal 112 is actuated, resulting in a counter-momentum for instant retraction of the pedal, positively influencing performance.

In addition, a wear coating 128 applied under the guide mount 118 ensures that the latter is always at the same level.

The control pedal is movably positively connected to the spring loaded axial motion piston via a link featuring a screw-in spindle so that the piston is precisely axially reciprocated on actuation of the control pedal.

There is also the possibility of optionally varying the position of the piston or inclination of the pedal by means of a fitted setscrew, after which the position once set always remains exactly the same.

The steel cable secured in the axial motion piston leads via a cable guide to a lift-off device with the control hook. This lift-off device can be mounted on the three-stage automatic system and eccentrically clamped in place by a quarter to half a turn of a lever, no tool being needed for this.

Optionally varying the position of the control pin for tuning is also possible by means of setscrews provided, after which, again, the position once set always remains exactly the same.

Non-actuation of the control pedal automatically results in the snare band being lifted off from the snare head, whereas stepping on the control pedal moves the snare band continuously variable to the snare head, and as soon as stepping is released, the snare band drops away from the snare head.

When the drummer wishes to play prolonged with the snare band applied he can simply toe the control pedal to mechanically hook it fixed without interrupting drumming, the snare band then being in contact with the snare head. The drummer can then take his foot off the pedal and concentrate on using the other pedals. When he wishes to return to continuously varying the snare band, all he has to do is to toe the control pedal to instantly release its lock in returning to the continuously variable function as before.

In other words, the system now makes it possible for the drummer to set the snare band precise to a $100^{th}$ of a millimeter in relation to the snare head with exact repetition accuracy, thus giving him full control of his performance.

Again, it is understood that the example aspects and features as described, especially the dimensional indications as shown, are to be appreciated as being purely by way of an example and must not be deemed to limit the scope of patenting in any way.

What is claimed is:

1. A snare band adjustment and locking device of a snare drum, comprising:

an adjustment mechanism for adjusting a first setting in which the snare band is lifted off from the snare head and for adjusting a second setting in which the snare band has a predetermined maximum contact pressure with the snare head, wherein the adjustment mechanism comprises a positioning mechanism, and wherein a third setting of the adjustment mechanism is provided in which the contact pressure of the snare band with the snare head can be continuously varied between the contact pressure in the first setting and the contact pressure in the second setting by means of the positioning mechanism, wherein the positioning mechanism comprises:

a control member having an opening, a control lever inserted into the opening of the control member, and a compression spring positioned between the control lever and the control member;

wherein the control lever is actuated by a foot pedal via a sheathed cable or wire against the force of the compression spring, such that upon actuation of the foot pedal a linear movement of the control lever is generated to adjust the position of the snare band relative to the snare head via a linear movement of the snare band.

2. The device as set forth in claim 1, wherein the adjustment mechanism comprises at least one of a first and a second actuating element which can be actuated to make the change from the first or the second setting into the third setting.

3. The device as set forth in claim 1, wherein the device comprises at least one pretensioned roll.

4. The device as set forth in claim 1, wherein the device comprises at least two lift-off mechanisms to lift-off the snare band from the snare head of the drum.

5. The device as set forth in claim 1, wherein the device comprises at least one compression screw which is presettable to automatically obtain the wanted maximum contact pressure of the snare band on the drum.

6. The device as set forth in claim 1, wherein the control member is mounted so as to be continuously variable on a base member.

7. The device as set forth in claim 6, wherein the control member is shiftable in relation to the base member.

8. The device as set forth in claim 1, wherein the positioning mechanism comprises at least one elastic element for generating a return force at the foot pedal.

9. The device as set forth in claim 1, wherein the device comprises at least one securing system for removably securing the snare band to the positioning mechanism.

10. The device as set forth in claim 9, wherein the securing system comprises at least one lever actuatable for removing the snare band from the positioning mechanism.

11. The device as set forth in claim 9, wherein the securing system comprises at least one adapter removable from the positioning mechanism, the securing system comprising two levers to which the snare band is secured.

12. The device as set forth in claim 11, wherein the securing system comprises at least one latching mechanism for latching the adapter to the positioning mechanism.

13. The device as set forth in claim 12, wherein the securing system comprises at least one pushbutton actuatable for removing the snare band from the positioning mechanism.

14. The device as set forth in claim 9, wherein the securing system comprises at least one drilling in which at least one compression spring and a locating lug are arranged, the locating lug being urged by the compression spring into a closed position.

15. The device as set forth in claim 9, wherein the securing system comprises at least one actuating element, by the actuation of which the locating lug is urged against the force exerted by the compression spring into an open position.

16. The device as set forth in claim 15, wherein the actuating element is arranged rotatable.

17. The device as set forth in claim 9, wherein the securing system comprises a drilling in which at least two compression springs and two locating lugs are arranged which are pressed together by said compression springs.

18. The device as set forth in claim 17, wherein the securing system comprises two actuating elements rotatably arranged, by the actuation of which the locating lugs are splayed apart against the force exerted by said compression springs.

19. The device as set forth in claim 9, wherein the securing system comprises at least one latchable clip module.

20. The device as set forth in claim 19, wherein the clip module is arranged releasable at the adapter by actuating a pushbutton.

21. The device as set forth in claim 19, wherein the securing system comprises a cover plate, the clip module being arranged in the cover plate or disposed between the cover plate and a clip head.

* * * * *